US012319393B1

(12) United States Patent
Gerber et al.

(10) Patent No.: US 12,319,393 B1
(45) Date of Patent: Jun. 3, 2025

(54) FLOATING BOAT LIFT

(71) Applicant: Tidewater Marine Sales LLC, Riviera Beach, FL (US)

(72) Inventors: Charles Gerber, Stuart, FL (US); Jeremy C. Gerber, Stuart, FL (US)

(73) Assignee: Tidewater Marine Sales LLC, Riviera Beach, FL (US)

( * ) Notice: Subject to any disclaimer, the term of this patent is extended or adjusted under 35 U.S.C. 154(b) by 0 days.

(21) Appl. No.: 19/080,888

(22) Filed: Mar. 16, 2025

Related U.S. Application Data

(60) Provisional application No. 63/745,938, filed on Jan. 16, 2025, provisional application No. 63/569,338, filed on Mar. 25, 2024.

(51) Int. Cl.
*B63C 1/06* (2006.01)

(52) U.S. Cl.
CPC ..... *B63C 1/06* (2013.01)

(58) Field of Classification Search
CPC .... B63C 1/00; B63C 1/02; B63C 1/06; B63C 1/12
USPC ..... 114/44, 45, 46
See application file for complete search history.

(56) References Cited

U.S. PATENT DOCUMENTS 4,111,144 A * 9/1978 Ingvason ..... B63C 1/02 405/3
5,655,850 A * 8/1997 Holmgren ..... B63C 1/02 405/1
6,422,167 B1 7/2002 Bridges
7,007,620 B2 * 3/2006 Veazey ..... A01K 61/59 114/77 R
7,055,449 B2 * 6/2006 Brown ..... B63C 1/10 114/344
7,267,071 B2 * 9/2007 Brown ..... B63C 1/04 114/344
7,373,892 B2 * 5/2008 Veazey ..... E02D 27/06 114/77 R
7,603,959 B1 * 10/2009 Veazey ..... E02B 3/062 114/263
7,762,205 B1 * 7/2010 Veazey ..... B63B 3/08 405/15

(Continued)

OTHER PUBLICATIONS

H2 Harbor Hoist Brochure, https://marlon-files.s3.ca-central-1.amazonaws.com/Harbor_Hoist_H2_2024_brochure_2296c780a1.pdf. Mar. 15, 2025.

(Continued)

*Primary Examiner* — Daniel V Venne
(74) *Attorney, Agent, or Firm* — William J. Connelly, III; Connelly Law PLLC

(57) ABSTRACT

A floating boat lift is disclosed. The floating boat lift comprises a plurality of tanks, wherein each of the plurality of tanks comprises at least one indentation. Further, the floating boat lift comprises a top frame positioned and secured to the top surface of each of the plurality of tanks through one or more support brackets. The support brackets establish a connection with the top frame and the indentation of the respective tanks to create a clamping mechanism to avoid piercing the respective tanks and to maintain the structural integrity of each tank. Tanks are easily removed or replaced for maintenance purposes and may be added or removed to modify the size of the floating boat lift.

20 Claims, 24 Drawing Sheets

(56) References Cited

U.S. PATENT DOCUMENTS

| | | | | |
|---|---|---|---|---|
| 8,683,934 | B2 * | 4/2014 | Hey | B63C 3/06 114/46 |
| 8,979,426 | B2 * | 3/2015 | Doig | B63C 3/06 114/44 |
| 9,199,705 | B2 * | 12/2015 | Hey | B63C 3/06 |
| 11,027,800 | B1 | 6/2021 | Jopling | |
| 11,459,073 | B1 | 10/2022 | Moran | |

OTHER PUBLICATIONS

Installation Manual, Harborhoist by Hydrohoist Boat Lifts, 2019.

* cited by examiner

FLOATING BOAT LIFT

CROSS REFERENCE TO RELATED APPLICATION

This application claims the benefit of U.S. Provisional Patent Application Ser. No. 63/569,338 filed on Mar. 25, 2024 entitled "Floating Boat Lift" and U.S. Provisional Patent Application Ser. No. 63/745,938 filed on Jan. 16, 2025 entitled "Floating Boat Lift", the entire contents of which are hereby incorporated by reference in their entirety.

BACKGROUND

Field of Invention

Embodiments disclosed herein relate, in general, to a boat lift and, more particularly, to a floating boat lift.

Description of Related Art

The popularity of personal watercraft such as jet skis, speed boats, yachts, sail boats, row boats, kayaks, and the like for recreational and marine activities is on the rise. Traditionally, watercrafts are anchored in the water at a station such as a dock or a pier for easy access. However, there is a growing need to safely and easily lift watercraft out of the water and securely store the watercraft when not in use.

Various conventional systems such as lifts and floating docks have been proposed for this purpose. However, many of the conventional systems involve complex mechanical systems and are often cumbersome for a user to operate. Some conventional systems allow users to drive a personal watercraft directly onto a floating platform anchored within a water body or adjacent to a dock. In some other conventional systems, a winch is incorporated on an adjacent dock to raise the watercraft above the waterline or pull the watercraft from the water and onto another docking platform. However, while using many of the conventional systems to park and secure watercraft, a user can accidentally overshoot the floating platform potentially causing damage to the watercraft and/or platform itself. In addition, a watercraft operator may have difficulty achieving sufficient speed and maneuverability to place the watercraft onto the floating platform. Therefore, the conventional systems do not effectively integrate a boat lift into the dock in a practical, efficient, and commercially viable manner.

Further, docking stations are facing additional challenges to manage the increasing need for docking and boat lift platforms on existing waterways such as environmental considerations, governmental regulations, and community restrictions. For instance, the driving of pilings into a lakebed or similar water body could be prohibited due to aesthetic or potential environmental concerns. In some instances, installing pilings on a lakebed may prove to be exceedingly challenging if the lakebed consists of dense or impenetrable rock. In some conventional platforms, freely suspended docks and lifts are often used. These freely suspended docks and lifts tend to have a high center of gravity making them unstable particularly when facing rough wave action or strong wind conditions.

Some conventional dock systems are constructed using multiple floatation devices connected via a fixed frame. In many instances, the floatation devices are attached to the frame by bolting and/or screwing means whereby the bolts and/or screws are drilled into the floatation devices and/or tank structure itself. A common problem using this method is the creation of additional points of failure potentially resulting in a loss of tank pressure and or overall structural integrity of the floatation devices.

Lastly, many of the conventional docking systems are not customizable and may not be modified to accept larger or smaller watercraft. In addition, in conventional lift and floating dock systems, it is often difficult and cumbersome to remove, replace and/or maintain the respective floating tanks without having to dismantle the entire lift and/or floating dock.

Thus, there is a need for an improved and advanced floating boat lift that can administer the aforementioned limitations more efficiently and/or effectively.

SUMMARY

Embodiments in accordance with the present invention may provide a floating boat lift comprising a plurality of tanks with each of the plurality of tanks comprising at least one attachment indentation or attachment receptacle. The floating boat lift further comprises a top frame positioned on a top surface of each of the plurality of tanks. The floating boat lift further comprises one or more support brackets, wherein each of the one or more support brackets comprises at least one protrusion that is adapted to be fitted and/or plugged into the at least one attachment indentation of each of the plurality of tanks. Each of the one or more support brackets is further adapted to establish a connection with the top frame to each of the plurality of tanks. In an embodiment of the present invention, each top frame may be positioned and secured longitudinally on the top surface of each respective tank comprising the floating boat lift. In yet another embodiment of the present invention, the securing of the top frame to each respective tank using the at least one support bracket in conjunction with the at least one attachment indentation forms a clamping mechanism wherein each top frame is attached to the top surface of each respective tank in a manner so as not to pierce the tank surface of the tank itself. As such, embodiments of the present invention may aid in maintaining the structural integrity of the floating lift without creating additional points of failure or compromising structural integrity.

Embodiments in accordance with the present invention may provide a floating boat lift comprising a top frame positioned on a top surface of each of a plurality of tanks. The floating boat lift further comprises a plurality of attachment brackets that are arranged on each side of the top frame, each of the plurality of attachment brackets comprises one or more recesses. A plurality of fasteners are then passed through the one or more recesses of the respective attachment brackets to enable a series combination of the plurality of tanks.

Embodiments in accordance with the present invention may provide a floating boat lift comprising a plurality of tanks. Each of the plurality of tank is attached in a first series combination. Each of the plurality of tanks attached in the first series combination comprises one or more weldments attached on each of the plurality of tanks. The one or more weldments comprises one or more structural channels attached on a front side of each of the plurality of tanks using a plurality of fasteners. The one or more weldments further comprise a plurality of C-channels. The plurality of C-channels are arranged on a right side and a left side of each of the plurality of tanks. The plurality of C-channels are adapted to accommodate at least one tubing. The one or more weldments further comprise a plurality of mounting bolts installed on each of the plurality of C-channels. The plurality of mounting bolts are adapted to secure the at least one tubing accommodated in each of the plurality of C-channels. The one or more weldments further comprise a plurality of end plates extending from the plurality of C-channels. Each of the plurality of end plates are adapted to bind the one or more weldments with each of the plurality of tanks arranged in the first series combination. In a preferred embodiment of the present invention, the C-channels are secured to each of the plurality of tanks in a manner so as to not pierce the tank surface or the tank itself. As such, embodiments of the present invention may aid in maintaining the structural integrity of the floating lift without creating additional points of failure or compromising structural integrity.

Embodiments in accordance with the present invention may provide a floating boat lift comprising a plurality of tanks. Each of the tanks comprises a lower surface, a middle surface, an upper middle surface, a top surface, bottom surface, a side surface, and a back surface. Further, each of the tanks may comprise at least one structural indentation and/or cutout which may also be used as a step or handle. In an embodiment of the present invention, the at least one structural indentation and/or cutout may provide additional structural integrity to each tank. Each of the tanks may further comprise a valve for filling and dissipation of air from each of the tanks. Further, the tanks are arranged and coupled in a series manner and a parallel manner to construct the floating boat lift. The arrangement and coupling of the tanks are facilitated using fasteners. Each of the plurality of tanks are hollow structure to provide buoyancy to the floating boat lift. The floating boat lift enables a user to park a watercraft on a bunking structure of the floating boat lift and then lift the watercraft above a surface of the water body, when the watercraft is not in use.

Embodiments in accordance with the present invention may provide a floating boat lift comprising a plurality of tanks where each of the plurality of tanks comprises an opening on a bottom surface to allow for the ingress and egress of water into the respective tank(s) so as to control the height of the floating boat lift in the water. The amount of water in the respective tanks may be controlled by the amount of air pressure in the respective tanks. In an embodiment of the present invention, as air is released from the respective tanks via the valve, the amount of water in the respective tanks will increase causing the respective tanks and floating boat lift as a whole to become less buoyant and caused to lower in the water. Conversely, in an embodiment of the present invention, as the air pressure is increased in the respective tanks, water in the respective tanks may be forced out of the tank through the opening on the bottom surface thereby making the respective tank(s) and floating boat lift more buoyant and caused to rise in the water.

Embodiments in accordance with the present invention may provide a walking surface secured to the top frame. The walking surface may allow for safer movement of a user while on the dock itself, as well as, a means of ingress and egress from the watercraft and/or floating boat lift. In an embodiment of the present invention, the walking surface may comprise rubber, wood, carpet, composite material and/or any like material to provide durability, slip resistance, water resistance, ease of maintenance, comfort and aesthetic appeal Embodiments of the present invention may provide a floating boat lift that lifts a watercraft out of water when not in use.

Embodiments of the present invention may provide a floating boat lift that does not require any additional power supply or moving motor components to affect full actuation.

Embodiments of the present invention may provide a floating boat lift that enables easy maintenance of the watercraft.

Embodiments of the present invention may provide a floating boat lift that enables the ease of removal, maintenance and repair of a specific tank without the need to disassemble the floating boat lift in its entirety.

Embodiments of the present invention may provide a floating boat lift that is customizable and may be made larger through the addition of tanks or smaller by the removal of tanks to accommodate watercraft of various sizes.

Embodiments of the present invention may provide a floating boat lift that offers stability and prevents toppling off of the watercraft at high waters.

Embodiments of the present invention may provide a floating boat lift that is easily installable and useable in any water body.

Embodiments of the present invention may comprise a plurality of tanks attached together by external fasteners to avoid puncturing of the tanks thereby avoiding the possibility of additional water infiltration, loss of air pressure, and decreased structural integrity.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that are presently preferred, it being understood, however, that the embodiments disclosed herein are not limited to the specific instrumentalities disclosed. Included in the drawings are the following figures.

Figure 1A:
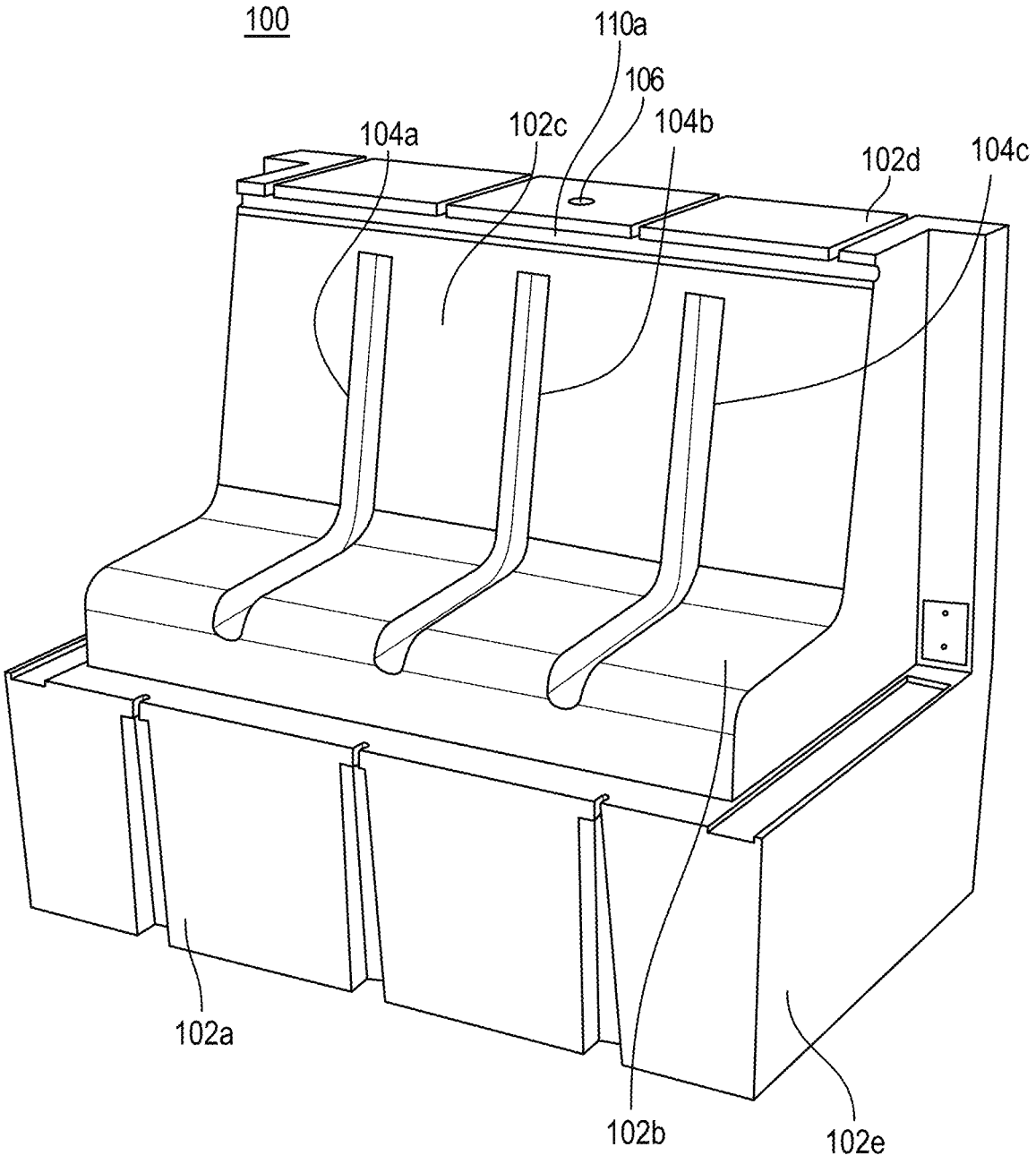
FIG. 1A illustrates a front view of a tank, according to embodiments of the present invention disclosed herein.

While embodiments of the present invention are described herein by way of example using several illustrative drawings, those skilled in the art will recognize the present invention is not limited to the embodiments or drawings described. It should be understood the drawings and the detailed description thereto are not intended to limit the present invention to the particular form disclosed, but to the contrary, the present invention is to cover all modifications, equivalents, and alternatives falling within the spirit and scope of embodiments of the present invention as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention will be described below in conjunction with an exemplary floating boat lift. Embodiments of the present invention are not limited to any particular type of floating boat lift. Those skilled in the art will recognize the disclosed techniques may be used in any floating boat lift in which it is desirable to provide an interim floating boat lift.

The phrases "at least one", "one or more", and "and/of" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B, and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material".

The term "first series combination" and variations thereof, as used herein, refers to a right-hand side of a series combination of tanks in a floating boat lift.

The term "second series combination" and variations thereof, as used herein, refers to a left-hand side of a series combination of tanks in a floating boat lift.

Figure 2A:
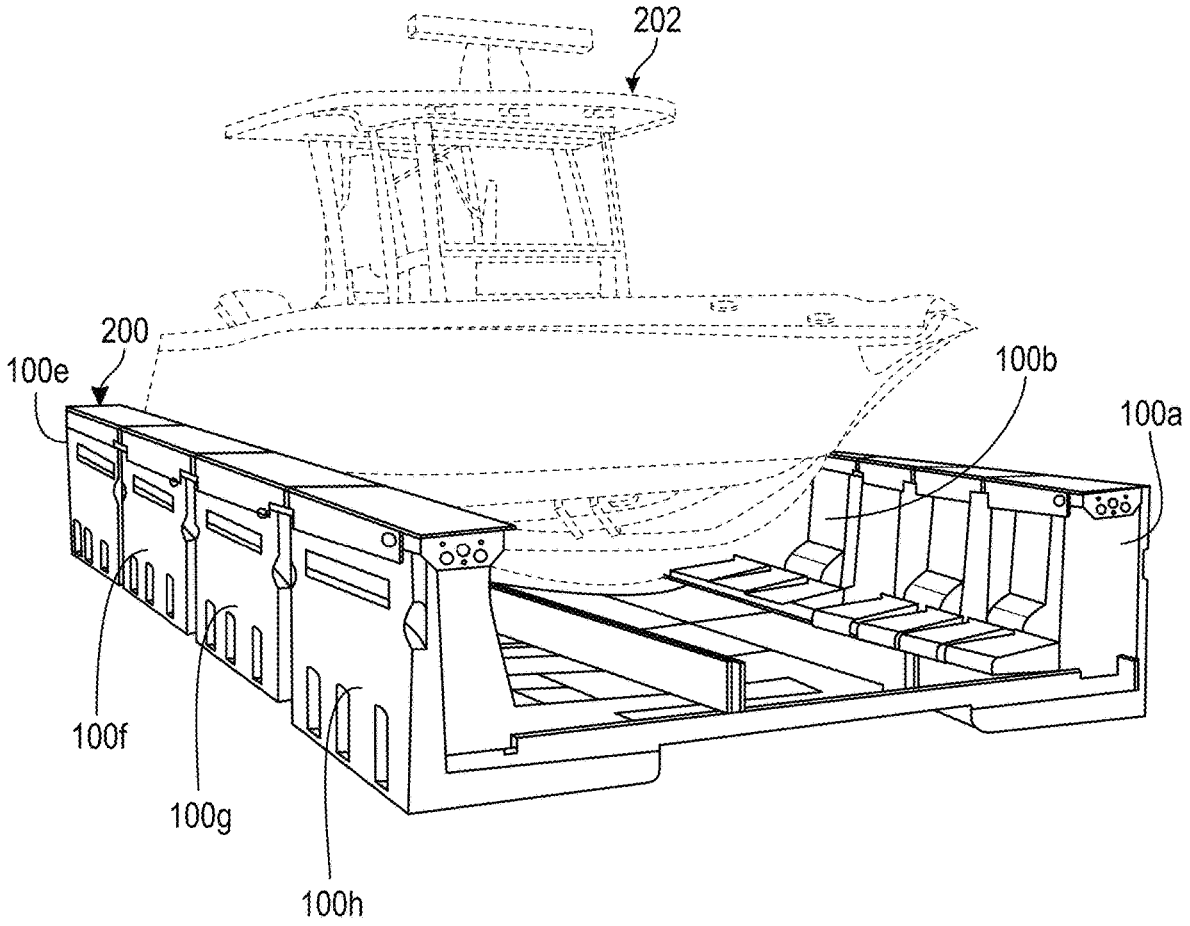
FIG. 2A illustrates a placement of a watercraft on the floating boat lift, according to embodiments of the present invention disclosed herein.

FIG. 1A illustrates a front view of a tank 100, according to an embodiment of the present invention. In an embodiment of the present invention, a plurality of the tanks 100 (hereinafter collectively referred to as the "tanks 100") may be arranged and coupled in a series manner and a parallel manner to construct a floating boat lift 200 (as shown in FIG. 2A). The floating boat lift 200 may enable a user to park a watercraft 202 on the floating boat lift 200 and then lift the watercraft 202 above a surface of a water body, when the watercraft 202 may not be in use. The water body may be, for example, but not limited to, a river, a sea, a lake, a pond, a stream, and so forth. Embodiments of the present invention are intended to include or otherwise cover any type of water body, including known, related art, and/or later developed technologies, where the floating boat lift 200 may be installed for parking and lifting the watercraft 202.

In an embodiment of the present invention, the tank 100 may be of a hollow structure. The hollow structure of the tank 100 may enable buoyancy of the floating boat lift 200 on the water body causing a lift of the floating boat lift 200 and further an uplift of the watercraft 202. In an embodiment of the present invention, the tank 100 may further comprise an opening (not shown) on the bottom of the tank 100 to allow for the ingress and egress of water into and out of the tank 100 in a controlled manner which will impact the overall buoyancy of the tank 100. In other embodiments of the present invention, the opening may be placed anywhere on the tank so as to allow for water to flow into and out of the tank in a controlled manner. In instances, where the floating boat lift 200 is to be lowered into the water, air is removed through a valve 106 of the respective tank(s) 100 allowing for water to flow into the respective tanks(s) 100 through the opening (not shown) thereby decreasing buoyancy of the floating boat lift 200. In instances where it is desirous to raise the tank(s) 100 and floating boat lift 200, air is introduced into the respective tank(s) 100 by way of the valve 106 forcing water out of the tank(s) through the bottom opening until the desired height is achieved. The air pressure within each tank 100 would then be maintained at a desired pounds per square inch (psi) to maintain a desired height in the water.

The tank 100 may be of any shape such as, but not limited to, an I shaped tank, a T shaped tank, an inverted T shaped tank, an O shaped tank, a cubical shaped tank, a cuboidal shaped tank, and so forth. In a preferred embodiment of the present invention, the tank 100 may be of an L shaped tank. Embodiments of the present invention are intended to include or otherwise cover any shape, including known, related art, and/or later developed technologies, of the tank 100.

The tank 100 may be constructed of a low-density polymeric material such as, but not limited to, a Polyolefin material, a low-density polyethylene (LDPE) material, a high-density polyethylene (HDPE) material, a plastic material, and so forth. Embodiments of the present invention are intended to include or otherwise cover any material for construction of the tank 100, including known, related art, and/or later developed technologies.

Figure 1B:
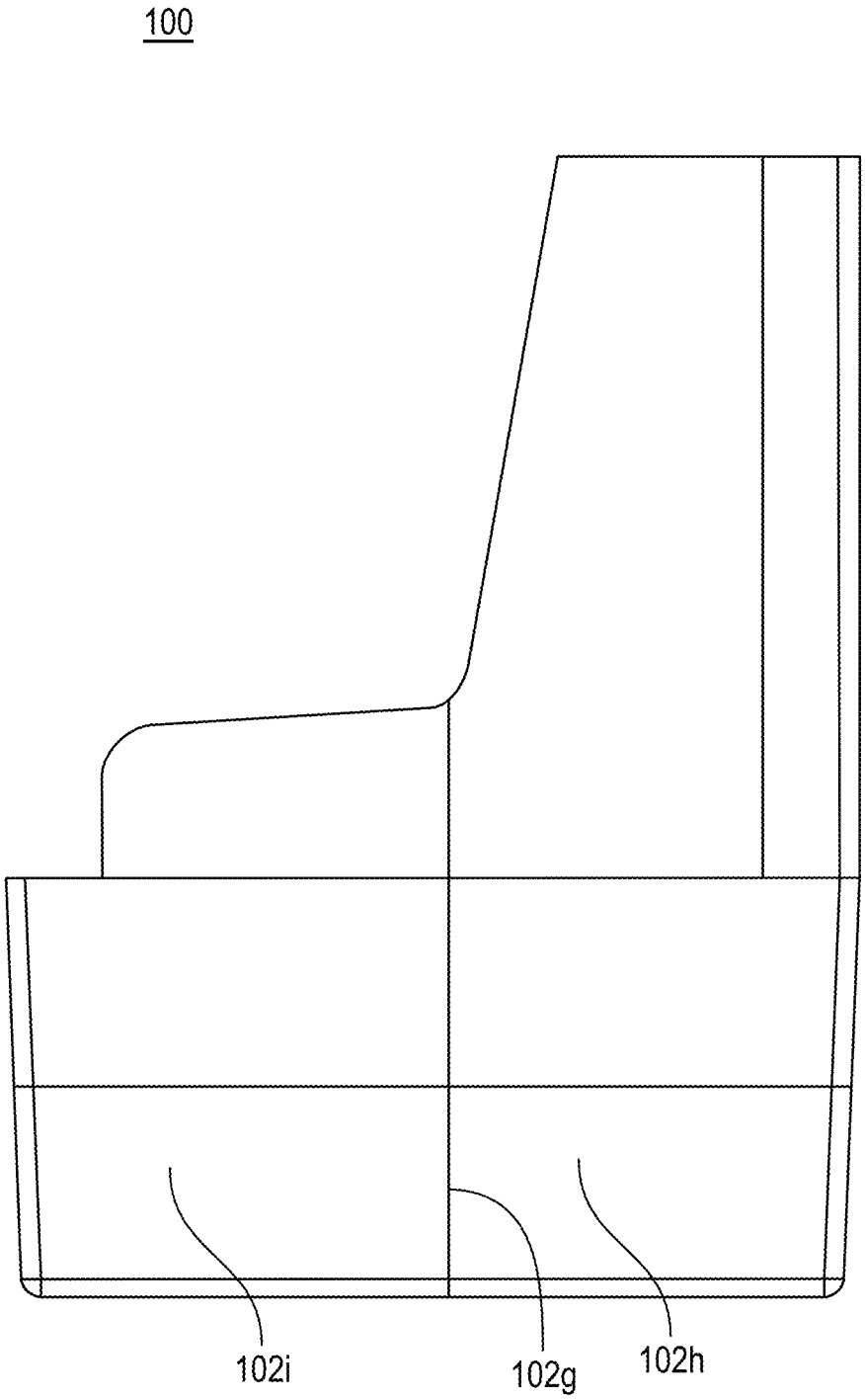
FIG. 1B illustrates a side view of the tank, according to embodiments of the present invention disclosed herein.
Figure 1C:
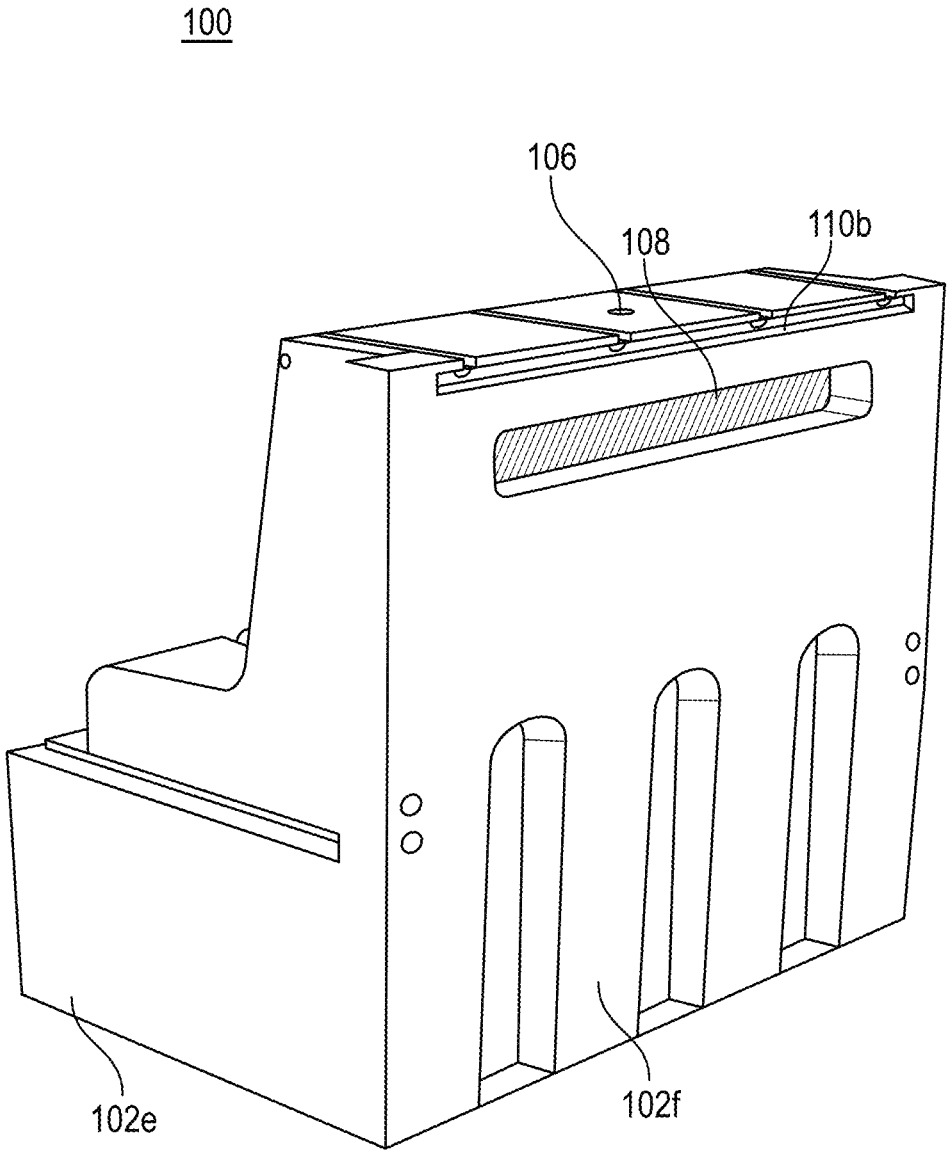
FIG. 1C illustrates a back view of the tank, according to embodiments of the present invention disclosed herein.

In an embodiment of the present invention, the tank 100 may comprise a lower surface 102*a*, a middle surface 102*b*, an upper middle surface 102*c*, a top surface 102*d*, a side surface 102*e*, bottom surface (not shown), and a back surface 102*f* (as shown in FIG. 1C).

In an embodiment of the present invention, the lower surface 102*a*, the middle surface 102*b*, the upper middle surface 102*c*, the top surface 102*d*, and the back surface 102*f* may comprise of multiple indentations and recesses, examples of which include, but are not limited to, are shown as 110*a*, 104*a*, 104*b* and 104*c*. The indentations and recesses may be utilized for gripping and stabilizing the tank 100, as well as, acting as attachment means in assembling a plurality of tanks 100 to construct the floating boat lift 200 (as shown in FIG. 2A). In another embodiment of the present invention, the indentations and recesses may be used as a stepping means for ingress and egress onto the floating boat lift 200 and/or watercraft. In yet another embodiment of the present invention, the indentations and recesses may add to the structural integrity of the floating boat lift 200.

The lower surface 102*a*, the middle surface 102*b*, the upper middle surface 102*c*, and the top surface 102*d* may be of any shape such as, but not limited to, a convex shape, a concave shape, and so forth. In a preferred embodiment of the present invention, the lower surface 102*a*, the middle surface 102*b*, the upper middle surface 102*c*, and the top surface 102*d* may be a flat surface. Embodiments of the present invention are intended to include or otherwise cover any shape, including known, related art, and/or later developed technologies, of the lower surface 102*a*, the middle surface 102*b*, the upper middle surface 102*c*, and the top surface 102*d*.

In an embodiment of the present invention, the tank may comprise at least one structural indentation shown in FIG. 1A as indentations 104*a*, 104*b*, and 104*c*. In FIG. 1A, the structural indentions extend from the middle surface 102*b* to the upper middle surface 102*c* of the tank 100. In other embodiments of the present invention, the at least one structural indentation may be located anywhere on the surface of the tank including, but not limited to, the lower surface 102*a*, the middle surface 102*b*, the upper middle surface 102*c*, the top surface 102*d*, the side surface 102*e*, and the back surface 102*f*.

In another embodiment of the present invention, the tank 100 may comprise at least one stepping cutout (not shown) as a means of ingress and egress to climb onto the floating boat lift 200 and into the watercraft 202 parked on the floating boat lift 200. The stepping cutout may be of any shape such as, but not limited to, a rectangular shape, a square shape, a circular shape, and so forth. In a preferred embodiment of the present invention, the stepping cutout may be of a rectangular shape with rounded corners. Embodiments of the present invention are intended to include or otherwise cover any shape of the stepping cutout that may be beneficial to provide a support to the user to climb into the watercraft 202.

In an embodiment of the present invention, the tanks 100 may comprise one or more valves 106 (hereinafter referred to as the "valves 106" or the "valve 106"), such as each tank 100 may have a corresponding valve 106. The valve 106 may be adapted for inclusion and/or exclusion of air from the hollow structure of tank 100. The valve 106 may be adapted to enable a flow of air to and from the inside of the tank 100. The working and functionality of the valve 106 may further be explained in detail in conjunction with FIG. 2A.

The side surface 102*e* may be of any shape such as, but not limited to, a concave shape, a flat surface, and so forth. In a preferred embodiment of the present invention, the side surface 102*e* may be a flat surface. Embodiments of the present invention are intended to include or otherwise cover any shape, including known, related art, or later developed technologies, of the side surface 102*e*. In an embodiment of the present invention, the floating boat lift 200 comprises the assembly of multiple tanks 100 whereby the side surface 102*e* of one tank would abut and be attached to the side surface 102*e* of a second adjoining tank as shown in FIGS. 2A and 2D.

In an embodiment of the present invention, at least one attachment indentation 110*a*, interchangeably referred to as an attachment recess, may be carved, etched and/or molded into the upper middle surface 102*c* of the tank 100. In a preferred embodiment of the present invention, the tank may comprise an attachment indentation 110*a* in the upper middle surface 102*c* of the tank 100 and an attachment indentation 110*b* (shown in FIG. 1C) in the back surface of the tank 100 (hereinafter referred to as the "attachment indentations" 110 or the "attachment indentation" 110). The attachment indentations 110 may provide an accommodation to an extended counterpart of several attachment means, including but not limited to a support bracket 212 shown in FIGS. 2D and 2E. Further, the attachment indentation 110 may be of a comparatively smaller size with respect to the extended counterpart, such that the smaller size may enable a plugging of the extended counterpart into the attachment indentation 110. Further, the attachment indentation 110 may provide a means of attachment for multiple tanks in a series and/or linear manner as shown in FIGS. 1F 2D and 2F.

FIG. 1B illustrates a side view of the tank 100, according to an embodiment of the present invention. In an embodiment of the present invention, a single parting line 102*g* may be adapted to join a first half 102*h* with a second half 102*i* of the tank 100. In an embodiment of the present invention, the first half 102*h* and the second half 102*i* of the tank 100 may be molded in different molds and then joined together at the single parting line 102*g*. The first half 102*h* and the second half 102*i* may be joined at the single parting line

102*g* using attachment means, according to an embodiment of the present invention. The attachment means may be for example, but not limited to, an adhesive means, a welding process, and so forth. Embodiments of the present invention are intended to include or otherwise cover any type of the attachment means, including known, related art, and/or later developed technologies, for conjoining the first half 102*h* and the second half 102*i* of the tank 100. In another embodiment of the present invention, the tank 100 may also be rotationally molded with polyethylene to create a single module without any seams or weak points.

In another embodiment of the present invention, the first half 102*h* may be molded in a first section of the mold, and the second half 102*i* may be molded in a second section of the same mold. Further, the first half 102*h* and the second half 102*i* of the tank 100 may be joined at the single parting line 102*g* by the same mold using heating means. The heating means may include for example, but not limited to, flame heating, electric heating, infrared heating, steam heating, and so forth. Embodiments of the present invention are intended to include or otherwise cover any heating means, including known, related art, and/or later developed technologies, for conjoining the first half 102*h* and the second half 102*i* of the tank 100 in the mold.

FIG. 1C illustrates a back view of the tank 100, according to an embodiment of the present invention.

In an embodiment of the present invention, the valve 106 may be adapted for inclusion and/or exclusion of air from the hollow structure of tank 100. The valve 106 may be adapted to enable the flow of air to and from the inside of the tank 100. The valve 106 may further be explained in detail in conjunction with the FIG. 2A.

In an embodiment of the present invention, the tank 100 may further comprise a handle 108. The handle 108 may be an indention in the tank 100. The handle 108 may be adapted to enable the user to grip the tank 100 while lifting the tank 100 or during a process of construction of the floating boat lift 200. Similar to the structural indentations 104*a*, 104*b*, and 104*c*, the handle 108 may provide additional structural integrity to the tank 100 by preventing excess bulging and compression leaks of the tank 100 when under maximum air pressure.

The handle 108 may be of any shape such as, but not limited to, a square shape, a rectangular shape, and so forth. In an embodiment of the present invention, the handle 108 may be of a semi-cylindrical shape. Embodiments of the present invention are intended to include or otherwise cover any shape of the handle 108, including known, related art, and/or later developed technologies.

In an embodiment of the present invention, the back surface 102*f* of the tank 100 may comprise an attachment indentation 110*b* analogous to the attachment indentation 110*a* shown in FIG. 1A. Similar to the attachment indentation 110*a*, the attachment indentation 110*b* may provide an accommodation to an extended counterpart of several attachments means. Further, the attachment indentation 110*b* may be of a comparatively smaller size with respect to the extended counterpart, such that the smaller size may enable a plugging of the extended counterpart into the attachment indentation 110*b*. Further, the attachment indentations 110*a* and 110*b* may provide a means of attachment for multiple tanks in a series and/or linear manner as shown in FIGS. 1F 2D and 2F. Attachment indentation 110*a* and attachment indentation 110*b* may be referred to as the "indentations" 110 or "indentation" 110.

Figure 1D:
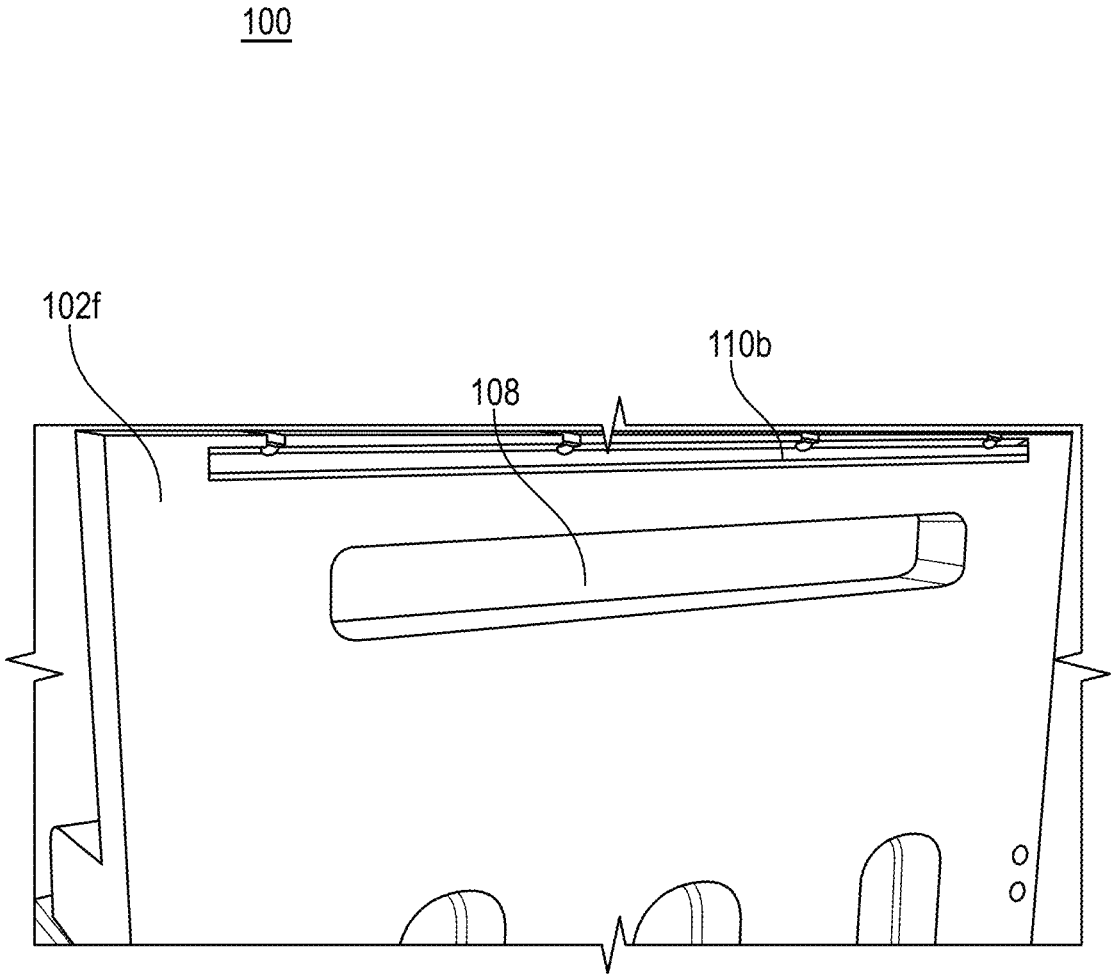
FIG. 1D illustrates a magnified back view of the tank, according to embodiments of the present invention disclosed herein.

FIG. 1D illustrates a magnified back view of the tank 100, according to an embodiment of the present invention. In an embodiment of the present invention, the stepping cutouts (not shown) and the handle 108 may include traction-inducing grip pads (not shown). The traction-inducing grip pads may be affixed to the stepping cutouts and the handle 108, in an embodiment of the present invention. The traction-inducing grip pads may provide friction and grip to enhance the stability of the hands and feet of the user while lifting and climbing on the tank 100 respectively. The traction-inducing grip pads may be for example, but not limited to, felt pads, a polyvinyl pad, a jute pad, and so forth. Embodiments of the present invention are intended to include or otherwise cover any type of traction-inducing grip pads, including known, related art, and/or later developed technologies, that may be affixed to the stepping cutouts and the handle 108. The traction-inducing grip pads may be affixed using means such as, but not limited to, a pasting means, a gluing means, a stitching means, and so forth. Embodiments of the present invention are intended to include or otherwise cover any means, including known, related art, and/or later developed technologies, for affixing the traction-inducing grip pads to the stepping cutouts (not shown) and the handle 108 of the tank 100. In yet another embodiment of the present invention, a slip resistant texture may be molded directly into the tank 100.

In an embodiment of the present invention, an attachment indentation 110*b* may be carved out on the back surface 102*f* of the tank 100. The attachment indentation 110*b* may provide an accommodation to an extended counterpart of several attachments means. Further, the attachment indentation 110*b* may be of a comparatively smaller size with respect to the extended counterpart, such that the smaller size may enable a plugging of the extended counterpart into the attachment indentation 110*b*. Further, the attachment indentations 110 may provide a means of attachment for multiple tanks in a series and/or linear manner as shown in FIGS. 1F 2D and 2F.

Figure 1E:
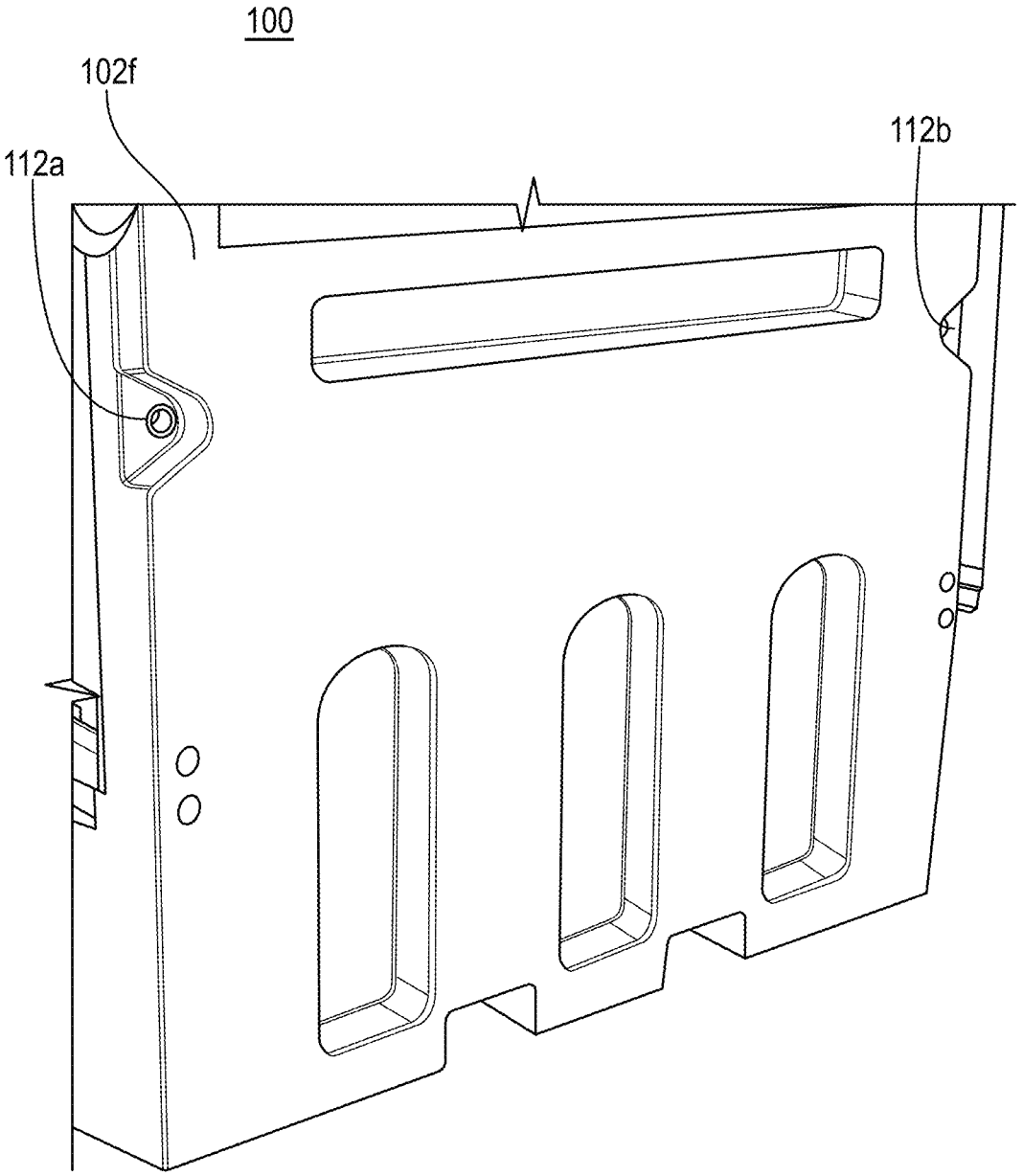
FIG. 1E illustrates a back view of the tank, according to another embodiment of the present invention disclosed herein.
Figure 1F:
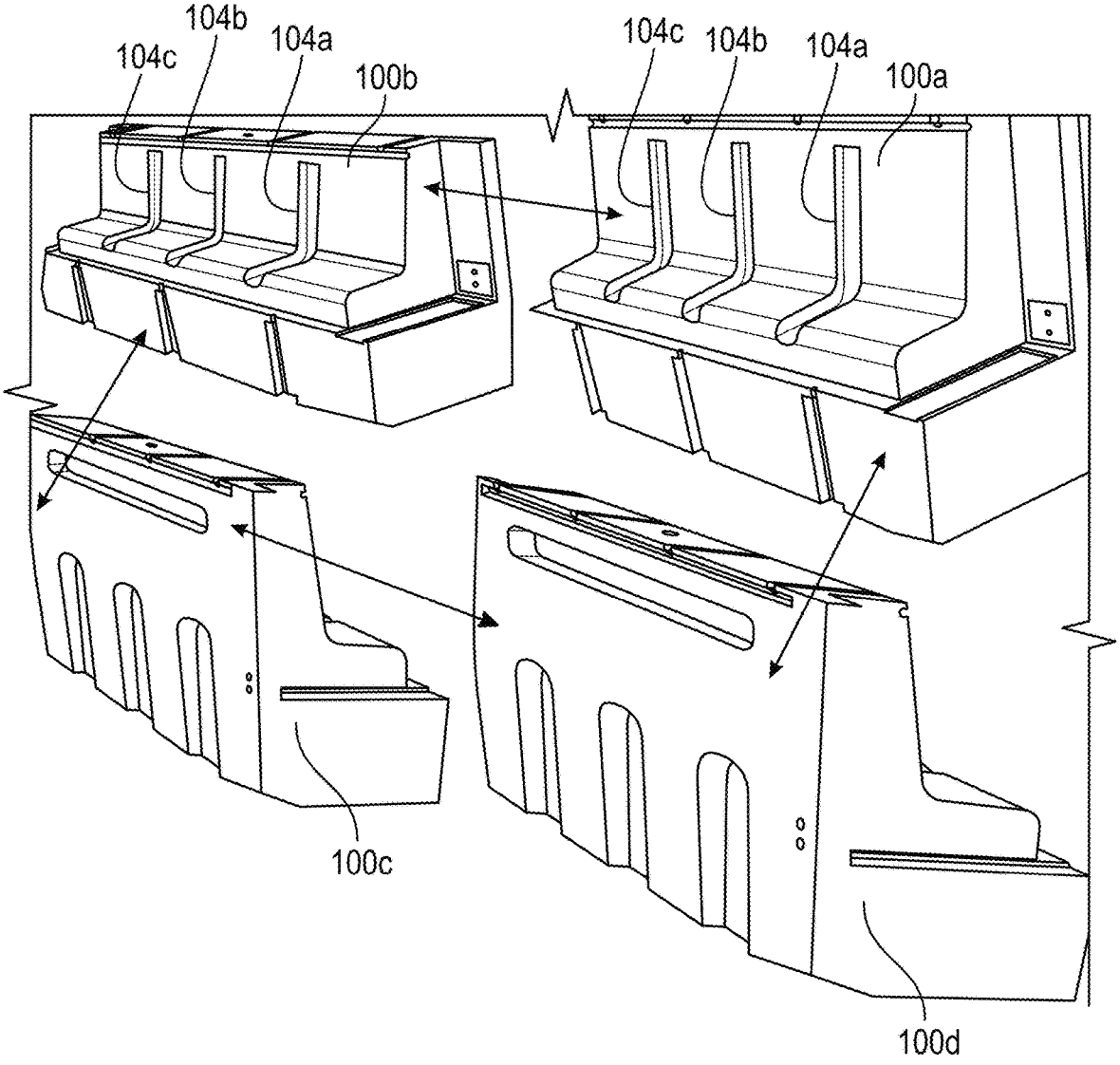
FIG. 1F illustrates a combo-connectivity of the tank in a series manner and a parallel manner, according to embodiments of the present invention disclosed herein.

FIG. 1E illustrates a back view of the tank 100, according to another embodiment of the present invention. In an embodiment of the present invention, triangular cutouts 112*a*-112*b* may be carved out on the back surface 102*f* of the tank 100. The triangular cutouts 112*a*-112*b* may be adapted for installation of resources such as, but not limited to, lanyards, indicator bands, brandings, lights, and so forth. Embodiments of the present invention are intended to include or otherwise cover any resources that may be installed into the triangular cutouts 112*a*-112*b* carved out on the back surface 102*f* of the tank 100, including known, related art, and/or later developed technologies.

Further, the triangular cutouts 112*a*-112*b* may feature an ingestion mechanism for enabling the installation of the resources. The ingestion mechanism may be, but not limited to, treads, jacks, sockets, plugs, ports, and so forth. Embodiments of the present invention are intended to include or otherwise cover any ingestion mechanism that may be enabled in the triangular cutouts 112*a*-112*b* for installation of the resources in the tank 100, including known, related art, and/or later developed technologies.

FIG. 1F illustrates a combo-connectivity of the tanks 100 in the series manner and the parallel manner, according to an embodiment of the present invention. In an embodiment of the present invention, the tank 100*a* and the tank 100*b* may be connected in the series manner. The series manner connectivity may be a side-to-side connectivity of the tank 100*a* and the tank 100*b*. The series manner connectivity of the tank 100*a* and the tank 100*b* may be achieved by securing together the attachment bracket (shown as 208 in FIG. 2B) of the top frame one tank 100*a* to the attachment bracket of the top frame of a second and adjoining tank 100*b*. In a preferred embodiment of the present invention, connectivity of the tank 100*a* and the tank 100*b* may be achieved using a combination of the top frame and attachment brackets. Similarly, the tank 100*c* and the tank 100*d* may be connected in the series manner. The series manner connectivity may be a side-to-side connectivity of the tank 100*c* and the tank 100*d*. The series manner connectivity of the tank 100*c* and the tank 100*d* may be achieved using the combination of the top frame and the attachment brackets as with tank 100*a* and 100*b*.

Further, the series combination of the tank 100*a*-tank 100*b* and the series combination of the tank 100*c*-tank 100*d* may be connected in the parallel manner to form the floating boat lift 200. The parallel manner connectivity may be a face-to-face connectivity of the series combination of the tank 100*a*-tank 100*b* and the series combination of the tank 100*c*-tank 100*d*. The parallel manner connectivity of the tank 100*a*-tank 100*b* and the tank 100*c*-tank 100*d* may be achieved using a combination of the tubings, C-channels and bolting mechanisms shown in FIG. 2F and FIG. 4B.

Figure 3C:
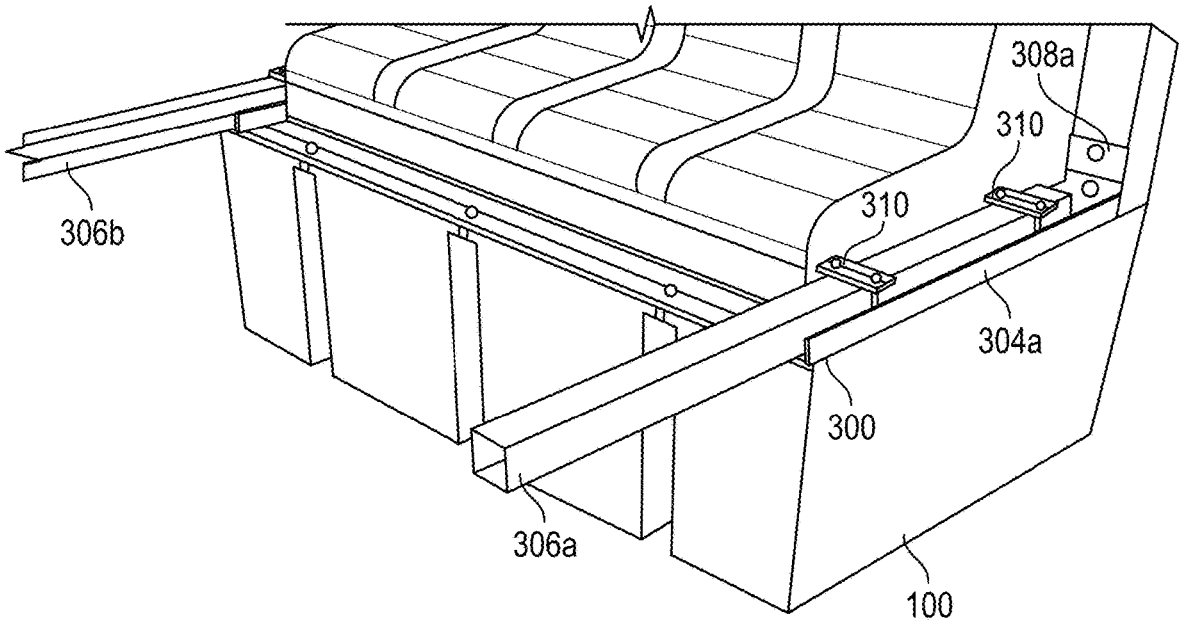
FIGS. 3C-3E illustrate an installation of tubings on the weldment on the tank, according to embodiments of the present invention disclosed herein.
Figure 3D:
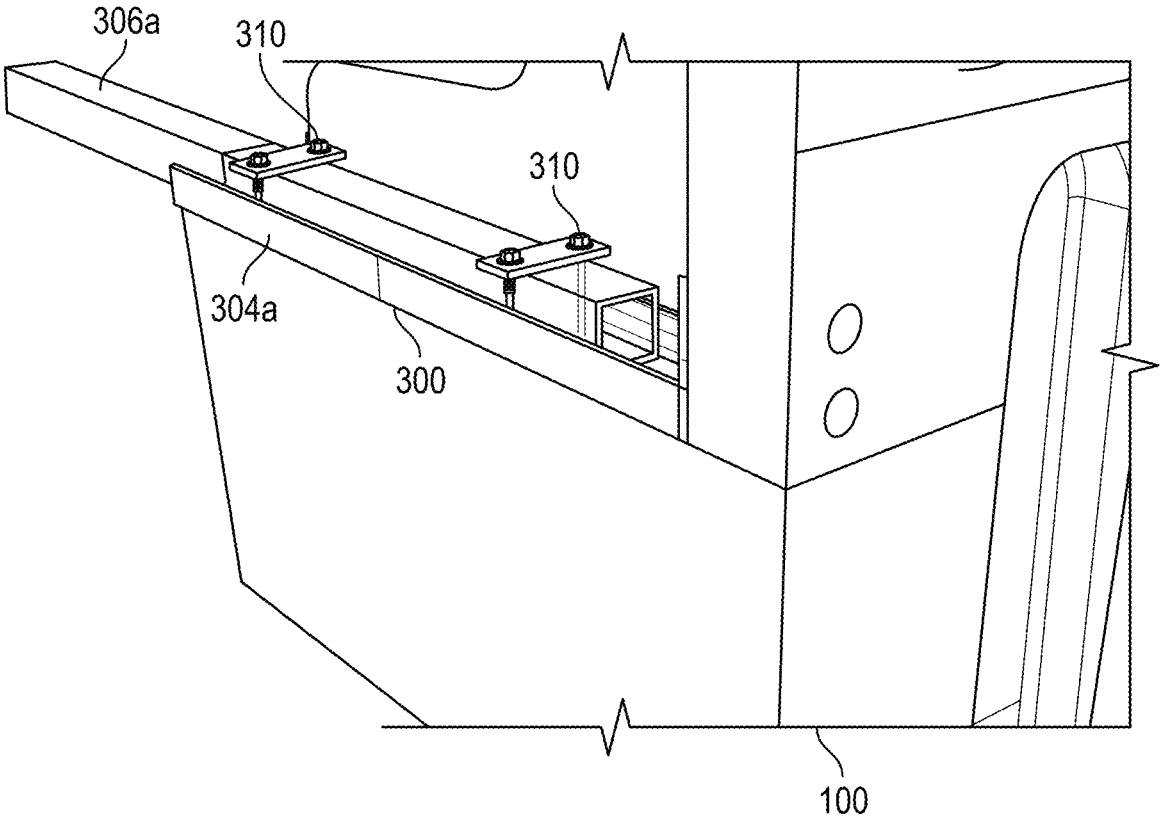
Figure 4A:
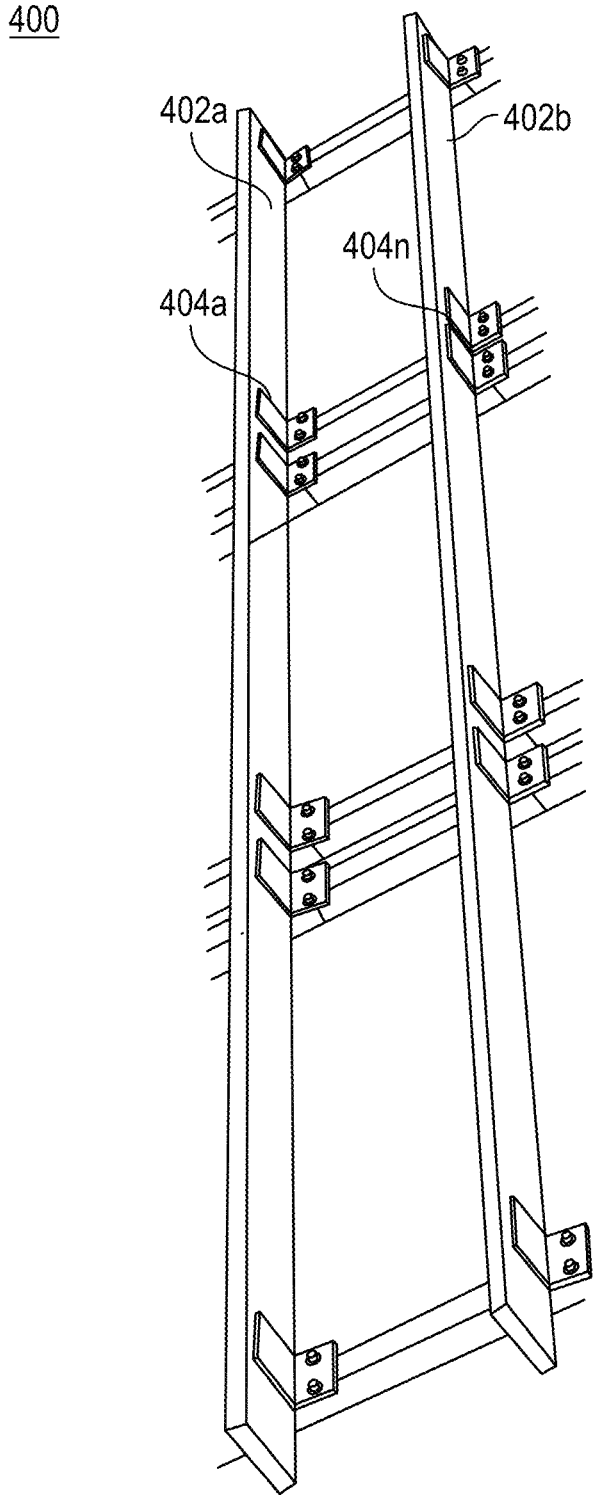
FIG. 4A illustrates a bunking structure, according to embodiments of the present invention disclosed herein.
Figure 4B:
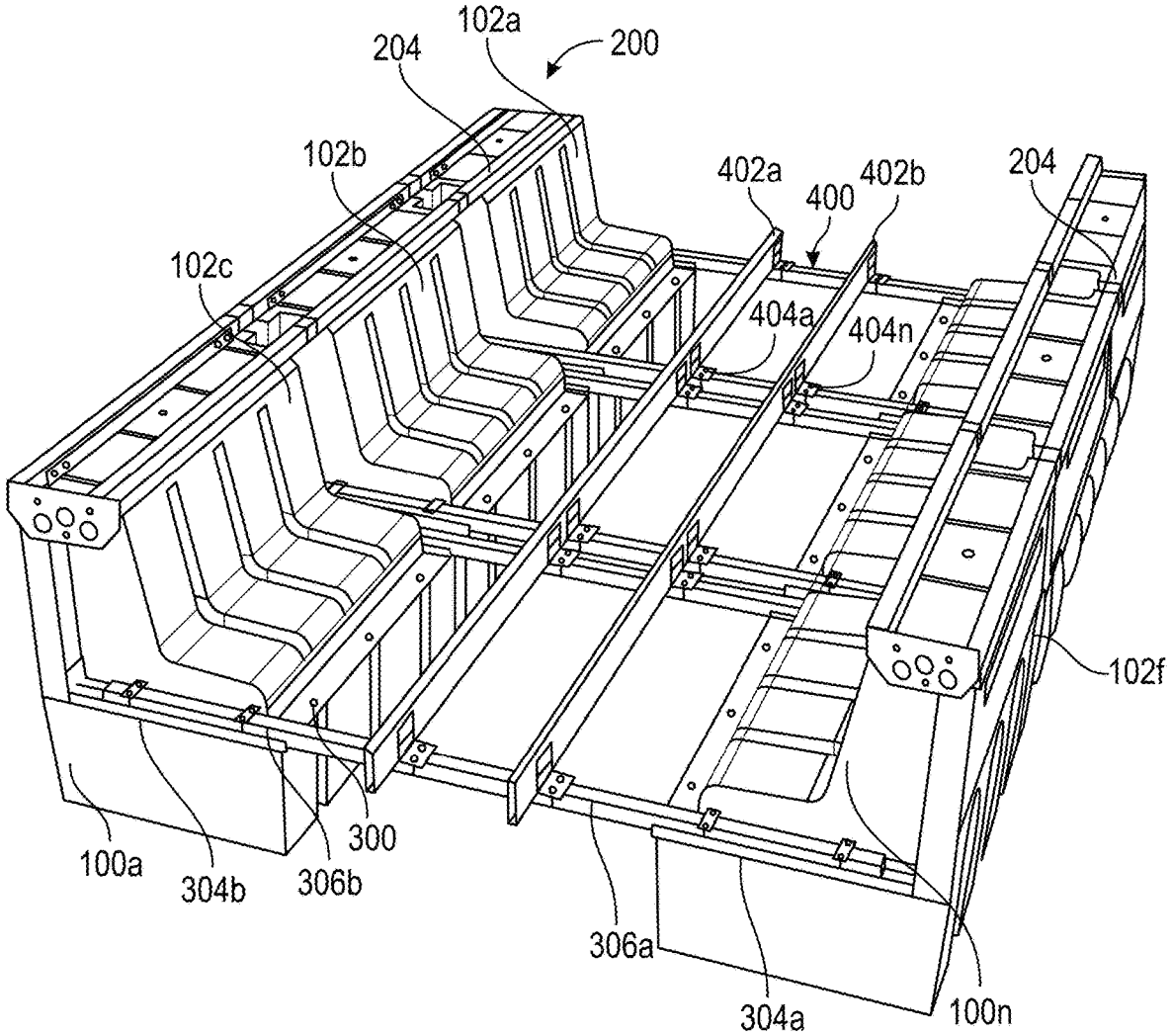
FIG. 4B illustrates an installation of the bunking structure on the floating boat lift, according to embodiments of the present invention disclosed herein.

In another embodiment of the present invention, parallel manner connectivity of the tank 100*a*-tank 100*b* and the tank 100*c*-tank 100*d* may be achieved through the attachment of a bunking system shown in FIG. 4B said bunking system adapted to accept the hull of a watercraft. The parallel manner connectivity may also be achieved using a combination of the tubings, the attachment brackets and bolting mechanisms shown in FIGS. 3C and 3D.

In another embodiment of the present invention, additional tanks 100 may be connected to an existing floating boat lift 200 to accommodate larger watercraft. In other embodiments of the present invention, tanks 100 may be removed from an existing floating boat lift 200 to accommodate smaller watercraft. The floating boat lift may be adjusted to accommodate watercraft of multiple lengths through the addition or subtraction of tanks 100.

FIG. 2A illustrates a placement of the watercraft 202 on the floating boat lift 200, according to embodiments of the present invention. In an embodiment of the present invention, the floating boat lift 200 may be constructed by the combo-connectivity of the tanks 100*a*-100*f* (as discussed above). The tank 100*a*, the tank 100*b*, and the tank 100*c* may be connected in the series combination, and the tank 100*d*, the tank 100*e*, and the tank 100*f* may, be connected in the series combination. Further, the series combination of the tanks 100*a*, 100*b*, 100*c* and the series combination of the tanks 100*d*, 100*e*, 100*f* may be connected in the parallel combination (as discussed above). The tanks 100*a*-100*f* may be combined by using fasteners such as, but not limited to, nuts, bolts, pipes, beams, and so forth to construct the floating boat lift 200. In another embodiment of the present invention, the parallel combination of tanks 100*a*, 100*b*, 100*c* and 100*d*, 100*e* and 100*f* may be achieved by the attachment of the bunking system shown in FIG. 4B, said bunking system adapted to accept the hull of a watercraft. The tanks 100*a*-100*f* may be combined by using fasteners such as, but not limited to, nuts, bolts, pipes, beams, and so forth to construct the floating boat lift 200.

In an embodiment of the present invention, the series combination and the parallel combination of the tanks 100 to form the floating boat dock 202 may be achieved in a manner so as not to pierce the surface of the respective tanks 100. In this embodiment of the present invention, the structural integrity of the respective tanks 100 comprising the floating boat lift 200 may be maintained without creating stress points and/or additional points of failure compromising structural integrity, additional water infiltration or loss of air pressure.

In an embodiment of the present invention, the floating boat lift 200 may be adapted to rise and float on the surface of the water body. In such an embodiment of the present invention, each tank 100 of the floating boat lift 200 may be filled with the air through the valve 106, (as discussed in FIG. 1A) that may enable the floating boat lift 200 to rise out of the water and lift the watercraft.

In an embodiment of the present invention, the tank 100 may further comprise an opening (not shown) on the bottom of the tank 100 to allow for the ingress and egress of water into and out of the tank 100 in a controlled manner which will impact the overall buoyancy of the tank 100. In other embodiments of the present invention, the opening may be placed anywhere on the tank so as to allow for water to flow into and out of the tank in a controlled manner. In instances, where the floating boat lift 200 is to be lowered into the water, air is removed through the valve 106 of the respective tank(s) 100 allowing for water to flow into the respective tanks(s) 100 through the opening(s) (not shown) thereby decreasing the buoyancy of the floating boat lift 200. In instances where it is desirous to raise the tank(s) 100 and floating boat lift 200, air is introduced into the respective tank(s) 100 by way of the valve 106 forcing water out of the tank(s) through the bottom opening until the desired height is achieved. The air pressure within each tank 100 would then be maintained at a constant pounds per square inch (psi) to maintain a desired height of the floating boat lift 200 in the water.

As air flow may be increased within the tanks 100, the buoyancy of the floating boat lift 200 may increase allowing the floating boat lift 200 to rise and start floating above the surface of the water body. The floating boat lift 200 may be uplifted and afloat on the surface of the water body, causing lifting of the watercraft 202. In an embodiment of the present invention, the increased buoyancy may result from the increased air pressure introduced into the tank(s) 100 forcing water out of the respective tank(s) 100 through the opening (not shown) on the bottom of the tank 100.

In another embodiment of the present invention, air may be removed from respective tanks 100 of the floating boat lift 200 to allow for the inflow of water into the respective tanks 100 through the bottom opening (not shown) thereby decreasing the buoyancy of the respective tanks 100. The decreased buoyancy of the respective tank(s) 100 may allow for the floating boat lift 200 to be submerged in the water body to a desired level. After submerging the floating boat lift 200 in the water body to a desired level, the user may maneuver the watercraft 202 off the floating boat lift 200.

In another embodiment of the present invention, the floating boat lift 200 may be submerged into the water body to a desired level to allow for docking the watercraft 202 on the floating boat lift 200. Once the watercraft 202 is positioned at a desired location on the floating boat lift 200, the floating boat lift 200 may be filled with air, as discussed above, to raise and lift the watercraft 202 out of the water. In an embodiment of the present invention, the watercraft 202 may be secured to the floating boat lift prior to the introduction of air into the tanks 100 of the floating boat lift 200.

In an embodiment of the present invention, it may be important for each valve 106 to have an equal flow of air so as to avoid imbalance and toppling of both the floating boat lift 200 and the watercraft 202. In an embodiment of the present invention, a motor (not shown) may be used to dissipate an equal amount of air to and from each of the valve 106. The motor may be for example, but not limited to, a well motor, a submersible motor, and so forth. Embodiments of the present invention are intended to include or otherwise cover any suitable motor, including known, related art, and/or later developed technologies, that may regulate air flow from each tank 100 through the valve 106. In yet another embodiment of the present invention, the flow of air to each tank 100 is monitored by way of computing system to ensure leveling of the floating boat lift 200. In other embodiments of the present invention the air flow to the respective tanks 100 is performed manually to ensure leveling of the floating boat lift 200.

According to embodiments of the present invention, the watercraft 202 placed on the floating boat lift 200 for lifting and parking may be for example, but not limited to, a jet ski, a speed boat, a yacht, a sailboat, a rowboat, a kayak, a coracle, and so forth, and so forth. Embodiments of the present invention are intended to include or otherwise cover any type of watercraft 202, including known, related art, and/or later developed technologies, that may be parked and lifted using the floating boat lift 200.

In yet another embodiment of the present invention, the floating boat lift 200 may comprise a removable, adjustable bracket (not shown) for attachment of additional accessories and components of the floating boat lift 200. In an embodiment of the present invention, the removable, adjustable bracket comprises a T-bracket that may be quickly attached and/or removed from the floating boat lift 200.

Figure 2B:
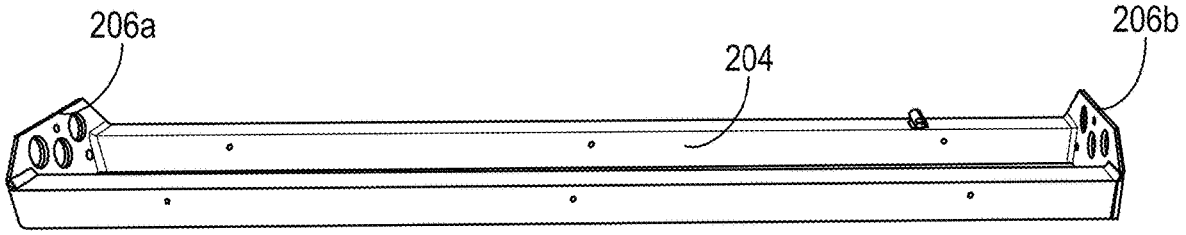
FIG. 2B illustrates a top frame, according to embodiments of the present invention disclosed herein.
Figure 2C:
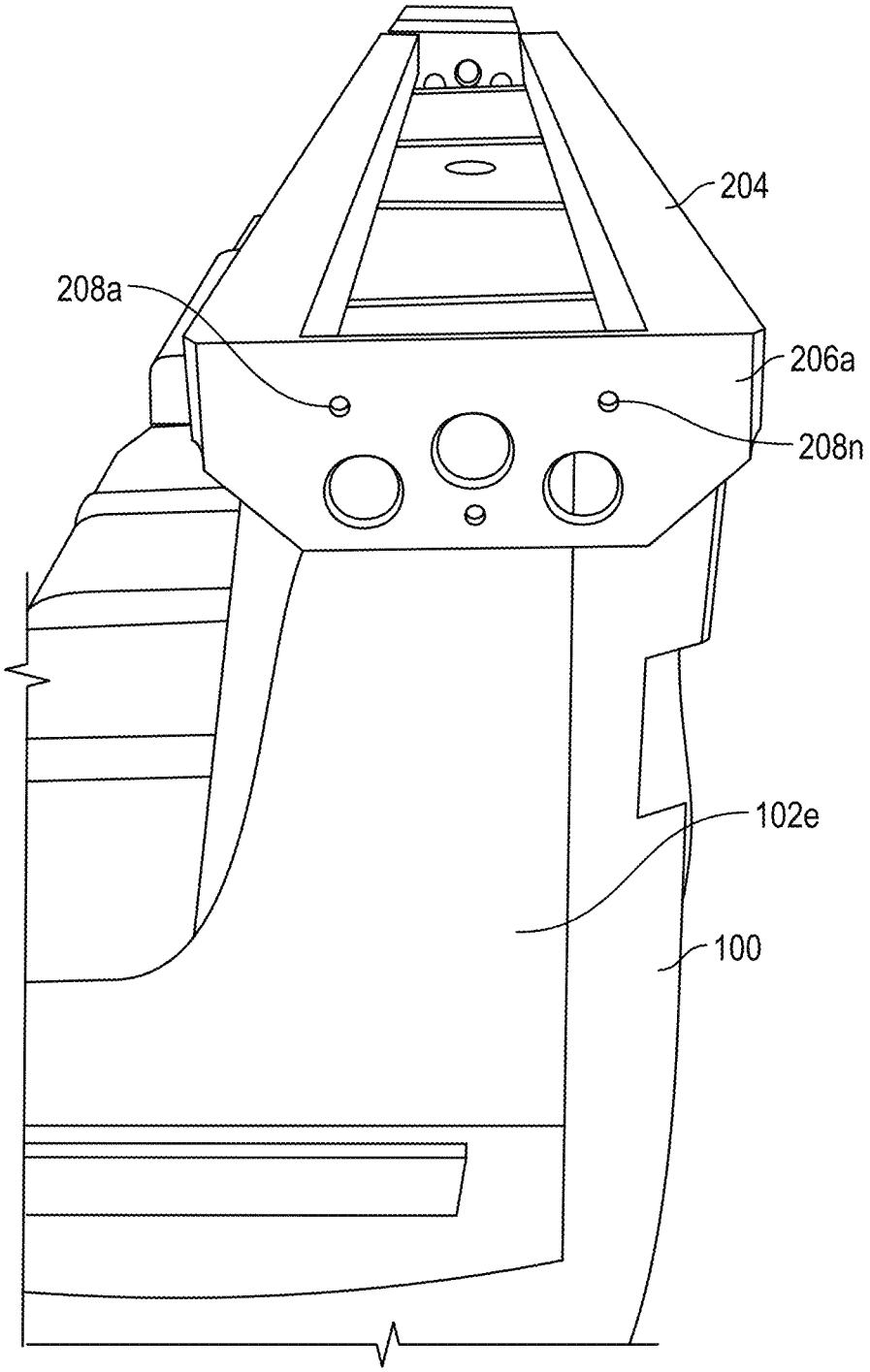
FIG. 2C illustrates a mounting of the top frame to the top of the tank, according to embodiments of the present invention disclosed herein.
Figure 2D:
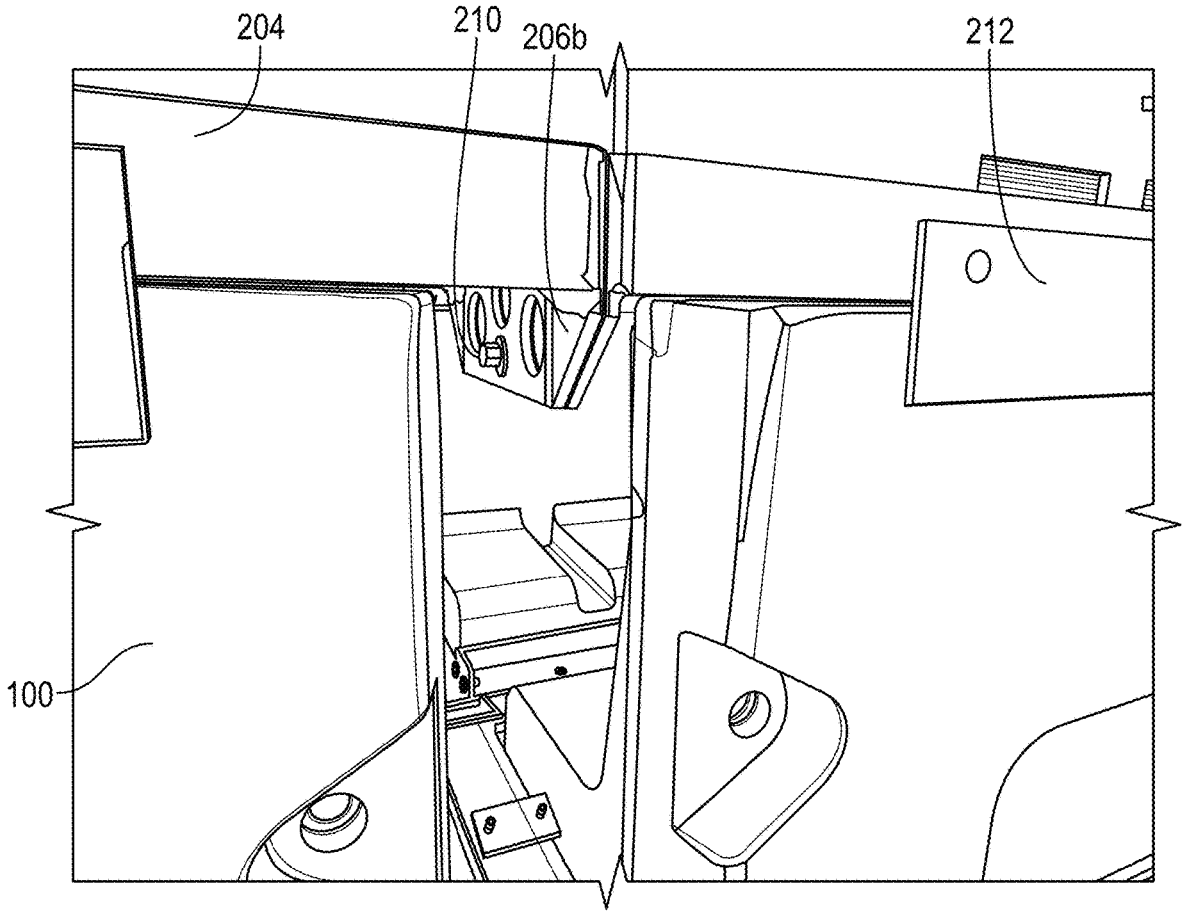
FIG. 2D illustrates a series combination of the tanks achieved using the top frame, according to embodiments of the present invention disclosed herein.

FIG. 2B illustrates a top frame 204 according to embodiments of the present invention. In another embodiment of the present invention, the top frame 204 frame may be adapted to be installed over the top surface 102*d* of the tank 100. In an embodiment of the present invention, the top frame may be installed longitudinally along the top surface 102*d* of the tank 100 as shown in FIG. 2C. Further, the dimensions (such as length and breadth) of the top frame 204 may comparably be equal to the dimensions of the top surface 102*d* of the tank 100. The top frame 204 may be constructed of any material such as, but not limited to, stainless steel, aluminum, carbon fiber, iron, and so forth. In an embodiment of the present invention, the top frame 204 may be constructed of marine grade aluminum. Embodiments of the present invention are intended to include or otherwise cover any material for construction of the top frame 204, including known, related art, and/or later developed technologies.

Further, the top frame 204 may comprise attachment brackets 206*a*-206*b*. In an embodiment of the present invention, the attachment brackets are located on each end of the top frame 204. The attachment brackets 206*a*-206*b* may further be explained in detail in conjunction with FIG. 2C.

FIG. 2C illustrates a mounting of the top frame 204 on the tank 100, according to embodiments of the present invention. The top frame 204 may be longitudinally mounted over the top surface 102*d* of the tank 100. Further, the top frame 204 may be mounted in such a manner that the attachment brackets 206*a*-206*b* may rest beyond the side surface 102*e* of the tank 100. In a preferred embodiment of the present invention the top frame 204 may be secured to the tank 100 in a clamping manner that will be shown in FIG. 2E so as not to pierce the tank surface of the tank itself. As such, embodiments of the present invention may aid in maintaining the structural integrity of the floating boat lift 200 without creating additional points of failure or compromising structural integrity.

The attachment brackets 206*a*-206*b* may be positioned on an extreme left side and on an extreme right side of the top frame 204. The attachment brackets 206*a*-206*b* may be positioned on each side (left and right) of the top frame 204 by utilizing facilities such as, but not limited to, a welding facility, a mounting facility, a locking facility, and so forth. Embodiments of the present invention are intended to include or otherwise cover any type of facility for situating the attachment brackets 206*a*-206*b* on the opposite ends of the top frame 204, including known, related art, and/or later developed technologies.

The attachment brackets 206*a*-206*b* may be constructed of any material such as, but not limited to, stainless steel, aluminum, carbon fiber, iron, and so forth. In a preferred embodiment of the present invention, the attachment brackets 206*a*-206*b* may be constructed of a marine grade aluminum. Embodiments of the present invention are intended to include or otherwise cover any suitable material for construction of the attachment brackets 206*a*-206*b*, including known, related art, and/or later developed technologies.

The attachment brackets 206*a*-206*b* may be constructed in any shape such as, but not limited to, a rectangular shape, a square shape, a circular shape, a semi-circular shape, a triangular shape, and so forth. In a preferred embodiment of the present invention, the attachment brackets 206*a*-206*b* may be constructed in a non-uniform hexagonal shape. Embodiments of the present invention are intended to include or otherwise cover any suitable shape for construction of the attachment brackets 206*a*-206*b*, including known, related art, and/or later developed technologies.

In an embodiment of the present invention, the attachment brackets 206*a*-206*b* resting beyond the side surface 102*e* of the tank 100 may comprise recesses 208*a*-208*n*. The recesses 208*a*-208*n* may be adapted to serially cojoin the attachment brackets 206*a*-206*b* of the next consecutive top frame 204. As the top frame 204 may be mounted onto the tank 100, the serial cojoining of the top frames 204, via the attachment brackets 206*a*-206*b*, may generate the series combination of the tanks 100 (as shown in the FIG. 2A). The serial cojoining of the recesses 208*a*-208*n*, the attachment brackets 206*a*-206*b*, and the top frame 204 to generate the series combination of the tanks 100 may further be explained in detail in conjunction with FIG. 1F. and FIG. 2D.

Additionally, the installation of the top fame 204 on the tank 100 may further be explained in detail in conjunction with FIG. 2D.

FIG. 2D illustrates the series combination of the 100 tanks by connecting the attachment brackets 206*a*-206*b* of the top frames 204 of adjoining tanks 100 according to embodiments of the present invention. For generating the series combination of the tanks 100, the recesses 208*a*-208*n* in the attachment brackets 206*a*-206*b* of the top frame 204 of the tank 100 may be joined with recesses 208*a*-208*n* in attachment brackets 206*a*-206*b* situated on the top frame 204 of an adjoining tank 100. The recesses 208*a*-208*n* in the adjoining attachment brackets 206*a*-206*b* may tie with the recesses 208*a*-208*n* in the attachment brackets 206*a*-206*b* of the tank 100 using means such as, but not limited to, high-tensile nylon fiber threads, a rope, a casted metallic connector, and so forth. In a preferred embodiment of the present invention, the recesses in the adjoining attachment brackets may be tied with the recesses 208*a*-208*n* in the attachment brackets 206*a*-206*b* using the fasteners. In a preferred embodiment of the present invention, the fasteners deployed in the recesses 208*a*-208*n* of the attachment brackets 206*a*-206*b* may be connecting bolts 210. Embodiments of the present invention are intended to include or otherwise cover any means for binding of the adjoining recesses 208*a*-208*n* in the adjoining attachment brackets 206*a*-206*b* situated on the adjoining top frame 204 with the recesses 208*a*-208*n* in the attachment brackets 206*a*-206*b* positioned on the top frame 204 of the tank 100, including known, related art, and/or later developed technologies.

Similarly, n' number of top frames 204 may be cojoined in the series combination, utilizing the recesses 208*a*-208*n* in the attachment brackets 206*a*-206*b*, to generate a first series combination and a second series combination of the floating boat lift 200. Where 'n' may be any positive integer.

In an embodiment of the present invention, the top frame 204 mounted on the tank 100 (or the top frame 204 mounted on the tanks 100 in the series combination) may further be installed and permanently fixated. The installation and the permanent fixation of the top frame 204 on the tank 100 may ensure a rigid amalgamation of the top frame 204 and the tank 100. Further, the installation of the top frame 204 on the tank 100 may be provisioned using a support bracket 212. The support bracket 212 may further be explained in detail in conjunction with FIG. 2E.

Figure 2E:
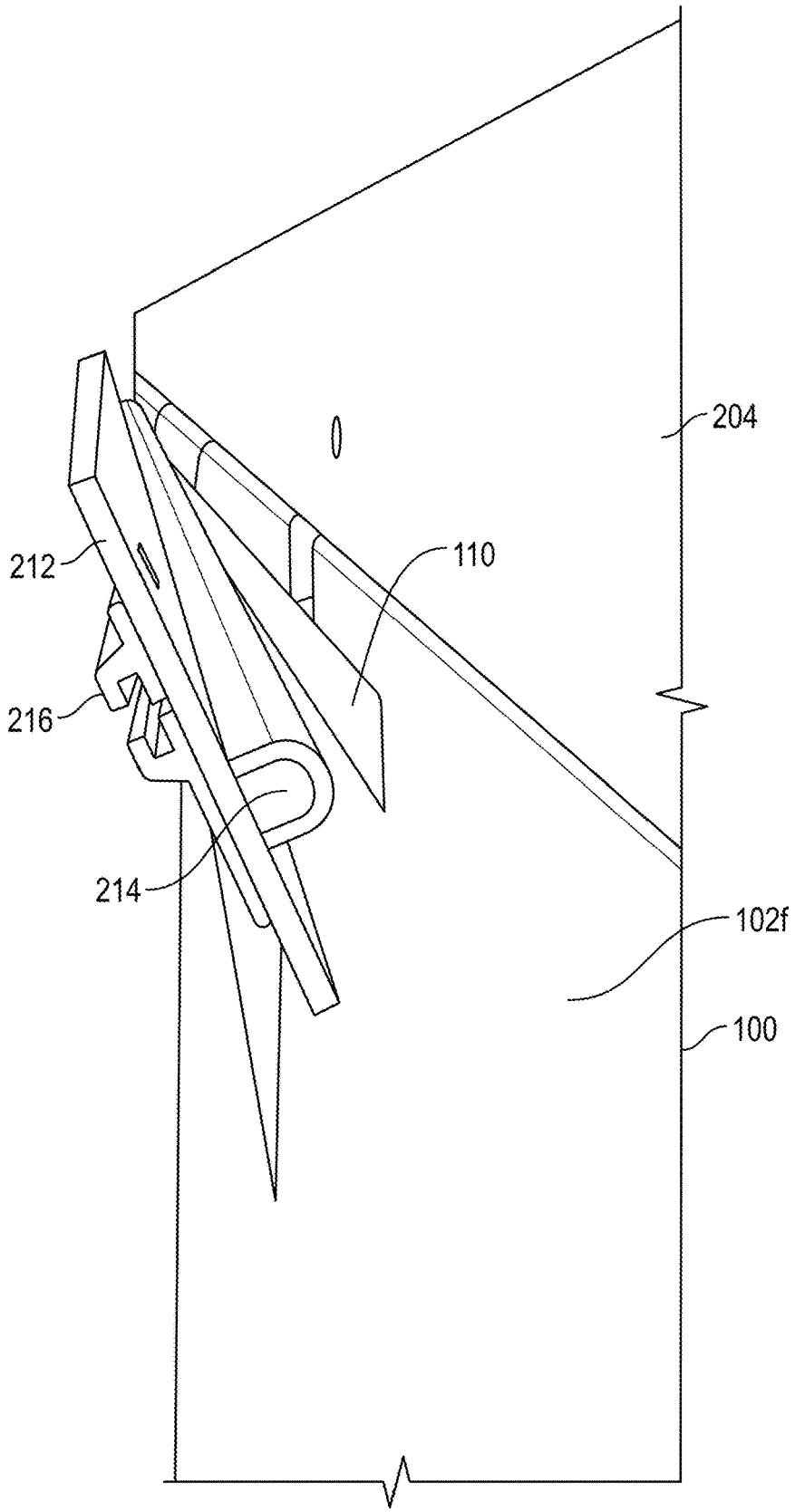
FIG. 2E illustrates a support bracket, according to embodiments of the present invention disclosed herein.
Figure 2F:
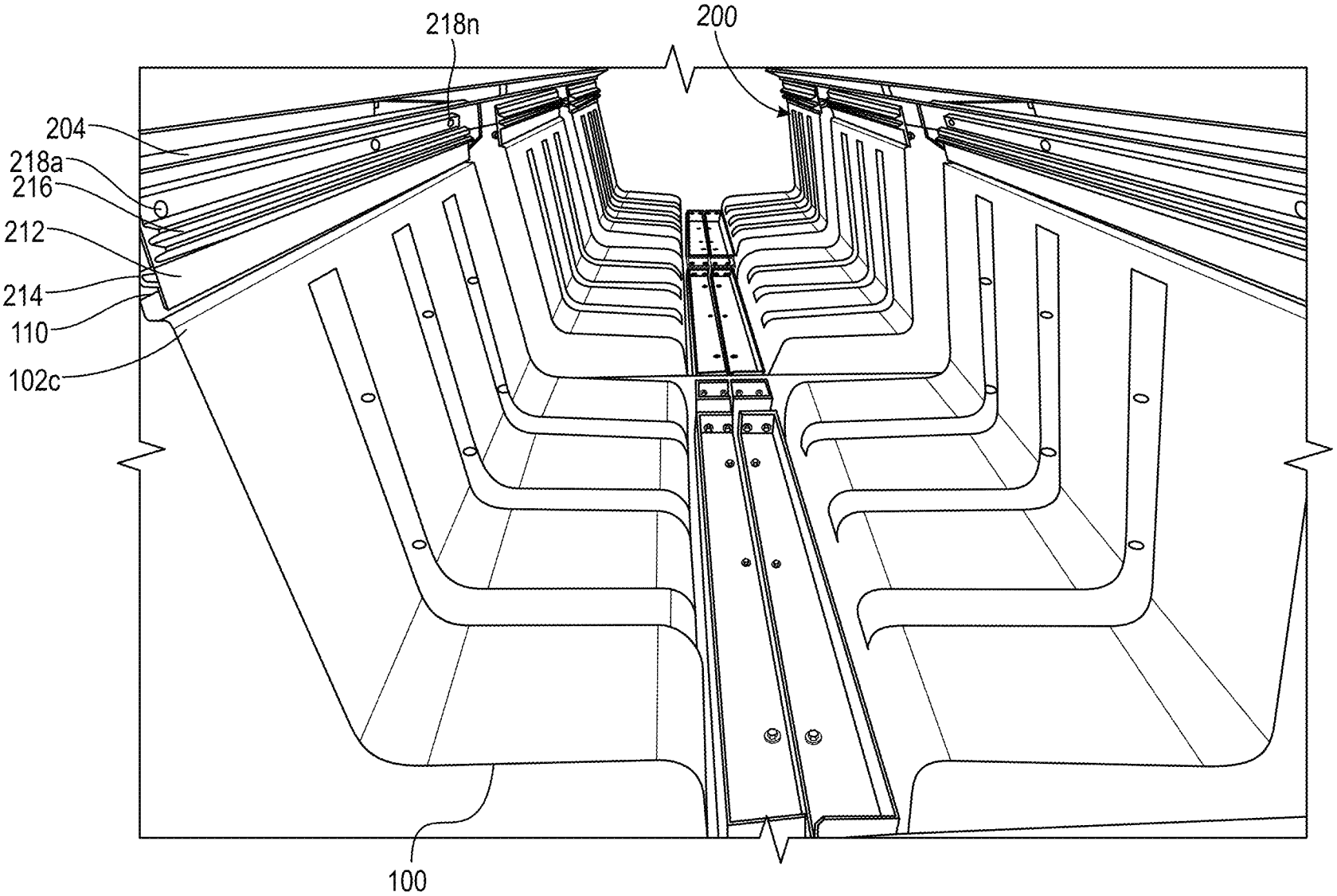
FIG. 2F illustrates the support bracket installed on the tank of the floating boat lift, according to embodiments of the present invention disclosed herein.

FIG. 2E illustrates the support bracket 212, according to embodiments of the present invention. The support bracket 212 may overlap the top frame 204 and the tank 100. The overlapping of the support bracket 212 may ensure a rigid contact between the top frame 204 and/or the back surface 102*f* of the tank 100. Further, the support bracket 212 may prevent dislodging and sliding off of the top frame 204 from over the tank 100. An additional support bracket 212 may also be used to ensure a rigid contact between the top frame 204 and the upper middle surface 102*c* of the tank 100.

In another embodiment of the present invention, a plurality of support brackets 212 may be used to secure the top frame 204 to both the back surface 102*f* of the tank 100 and upper middle surface 102*c* of the tank 100. In a preferred embodiment of the present invention, the securing of the top frame 204 to each respective tank 100 using a plurality of support brackets 212 in conjunction with the attachment indentations 110*a*-110*b* forms a clamping mechanism wherein each top frame 204 is attached to each respective tank 100 in a manner so as not to pierce the tank surface of the tank itself. As such, embodiments of the present invention may aid in maintaining the structural integrity of the floating lift without creating additional points of failure or compromising structural integrity.

The support bracket 212 may be constructed of any material such as, but not limited to, stainless steel, aluminum, carbon fiber, iron, and so forth. In a preferred embodiment of the present invention, the support bracket 212 may be constructed of a marine grade aluminum. Embodiments of the present invention are intended to include or otherwise cover any material for construction of the support bracket 212, including known, related art, and/or later developed technologies.

The support bracket 212 may be constructed in any shape such as, but not limited to, a pentagonal shape, a square shape, a circular shape, and so forth. In a preferred embodiment of the present invention, the support bracket 212 may be constructed in a rectangular shape. Embodiments of the present invention are intended to include or otherwise cover any shape for construction of the support bracket 212, including known, related art, and/or later developed technologies.

In an embodiment of the present invention, the support bracket 212 may comprise a protrusion 214. The protrusion 214 may be adapted to be inserted or plugged into the attachment indentation 110*b* on the back surface 102*f* of the tank 100. The protrusion 214 may also be adapted to be inserted or plugged into the attachment indentation 110*a* on the upper middle surface 102*c* of the tank. As the protrusion 214 may be inserted or plugged into the attachment indentation 110*a* and/or 110*b* of the tank 100, the support bracket 212 adjoining the protrusion 214 may start to overlap the top frame 204 and the tank 100. As the protrusion 214 is inserted and/or plugged into the attachment indentation 110 of the tank 100, the support bracket 212 may be fixated. Further, upon fixation of the support bracket 212 using the protrusion 214, the support bracket 212 may provide a guarding boundary to the top frame 204, as the support bracket 212 may be overlapping the top frame 204 and the tank 100. In an embodiment of the present invention, the support bracket 212 may further secured to the top frame 204. In another embodiment of the present invention, a plurality of support brackets 212 may be secured to the top frame 204.

The protrusion 214 may be situated on the support bracket 212 by utilizing facilities such as, but not limited to, a welding facility, a mounting facility, a locking facility, and so forth. Embodiments of the present invention are intended to include or otherwise cover any type of facility for situating the protrusion 214 on the support bracket 212, including known, related art, and/or later developed technologies.

The protrusion 214 may be constructed of any material such as, but not limited to, stainless steel, aluminum, carbon fiber, iron, and so forth. In a preferred embodiment of the present invention, the protrusion 214 may be constructed of a marine grade aluminum. Embodiments of the present invention are intended to include or otherwise cover any material for construction of the protrusion 214, including known, related art, and/or later developed technologies.

The protrusion 214 may be constructed in any shape such as, but not limited to, a cuboidal shape, a cubical shape, a hemispherical shape, and so forth. In a preferred embodiment of the present invention, the protrusion 214 may be constructed in a cylindrical shape. Embodiments of the present invention are intended to include or otherwise cover any shape for construction of the protrusion 214, including known, related art, and/or later developed technologies.

In an embodiment of the present invention, a slide track 216 may be adapted to accommodate accessories relating to the floating boat lift 200 and/or the watercraft 202. The slide track 216 may be located on a front surface of the support bracket 212. The positioning of the slide track 216 may better be understood as, the front location of the support bracket 212 that may be visible to the user. The accommodation of the accessories in the slide track 216 may further be explained in conjunction with FIG. 2G.

FIG. 2F illustrates the support bracket 212 installed on the upper middle surface 102*c* of the tank 100 of the floating boat lift 200, according to embodiments of the present invention. In an embodiment of the present invention, the support bracket 212 may be installed on the upper middle surface 102*c* of the tank 100. The installation of the support bracket 212 on the upper middle surface 102*c* may be administered and provisioned in a same manner as the support bracket 212 installed on the back surface 102*f* of the tank 100 (as explained in the FIG. 2E). Further, the support bracket 212 installed on the upper middle surface 102*c* may serve purposes that may be, but not limited to, installation of the accessories, providing stability to the watercraft 202, securing the watercraft 202 with the floating boat lift 200, and so forth. Embodiments of the present invention are intended to include or otherwise cover any purposes, including known, related art, and/or later developed technologies.

In an embodiment of the present invention, the support bracket 212 may be installed on the top frame 204. Further, the top frame 204 and the support bracket 212 may be connected through the fasteners. In an embodiment of the present invention, the support bracket 212 may be attached to the top frame 204. The fasteners may be deployed to ensure an immovable nuptial of the top frame 204 and the support bracket 212 with respect to the upper middle surface 102*c* of the tank 100. In an embodiment of the present invention, the fasteners deployed with the top frame 204 and the support bracket 212 may be studs and bolts 218*a*-218*n*.

Further, the support bracket 212 may be engaged with the upper middle surface 102*c* by insertion of the protrusion 214 inside of the attachment indentation 110*a*. Moreover, the support bracket 212 may further comprise the slide track 216. The slide track 216 may be adapted for installation of the accessories relating to the floating boat lift 200. The installation of the accessories in the slide track 216 may further be explained in conjunction with the FIG. 2G.

Figure 2G:
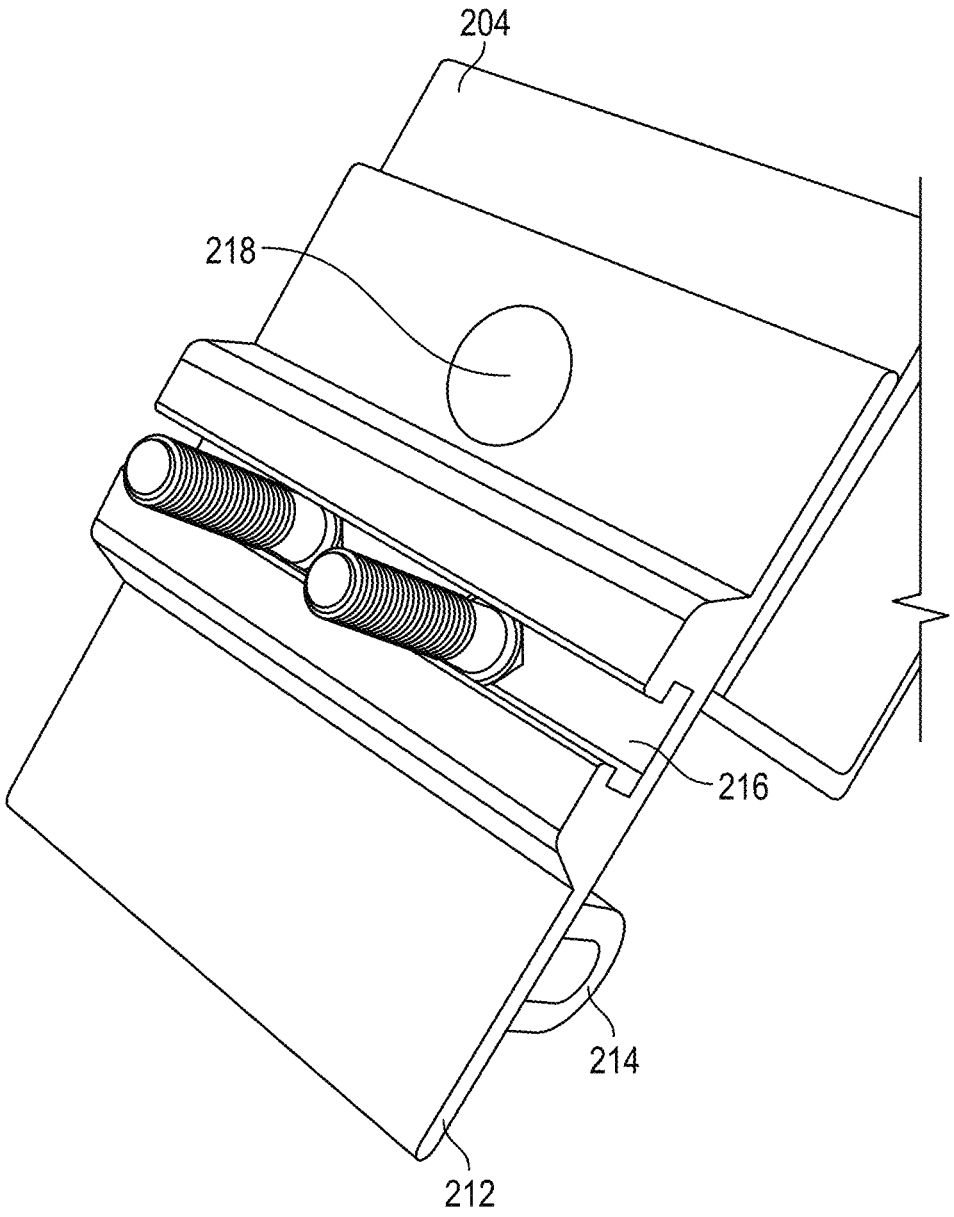
FIG. 2G illustrates a front view of the support bracket, according to embodiments of the present invention disclosed herein.

FIG. 2G illustrates a front view of the support bracket 212, according to embodiments of the present invention. In an embodiment of the present invention, the support bracket 212 and the top frame 204 may be connected through a fastener 218. The fastener 218 may be deployed to ensure an immovable nuptial of the top frame 204 and the support bracket 212. In an embodiment of the present, the fasteners 218 deployed with the top frame 204 and the support bracket 212 may be a stud and bolt.

In an embodiment of the present invention, the slide track 216 of the support bracket 212 may be adapted to accommodate accessories. The slide track 216 may be adapted to accustom a movable adapter (not shown). Further, the accessories may be installed on the movable adapter, provisioning functionalities of the accessories with the floating boat lift 200 and/or the watercraft 202.

In an exemplary scenario, an accessory 'standard dock cleat' (not shown) may be paired with the movable adapter. The 'standard dock cleat' may provide an ease of docking for the watercraft 202. In another exemplary scenario, an accessory 'flexible mooring system' (not shown) may be paired with the movable adapter. The 'flexible mooring system' may allow the floating boat lift 200 to move and adjust in a vertical direction with a changing course of tides of the waterbody. Further, the accessories such as, but not limited to, the 'standard dock cleat', 'flexible mooring system', and so forth, may be paired with the movable adapter by means such as, but not limited to, screwing, bolting, plugging, tying, sticking, and so forth. Embodiments of the present invention are intended to include or otherwise cover any means for pairing of the accessories with the movable adapter accustomed in the slide track 216 of the support bracket 212, including known, related art, and/or later developed technologies.

Figure 2H:
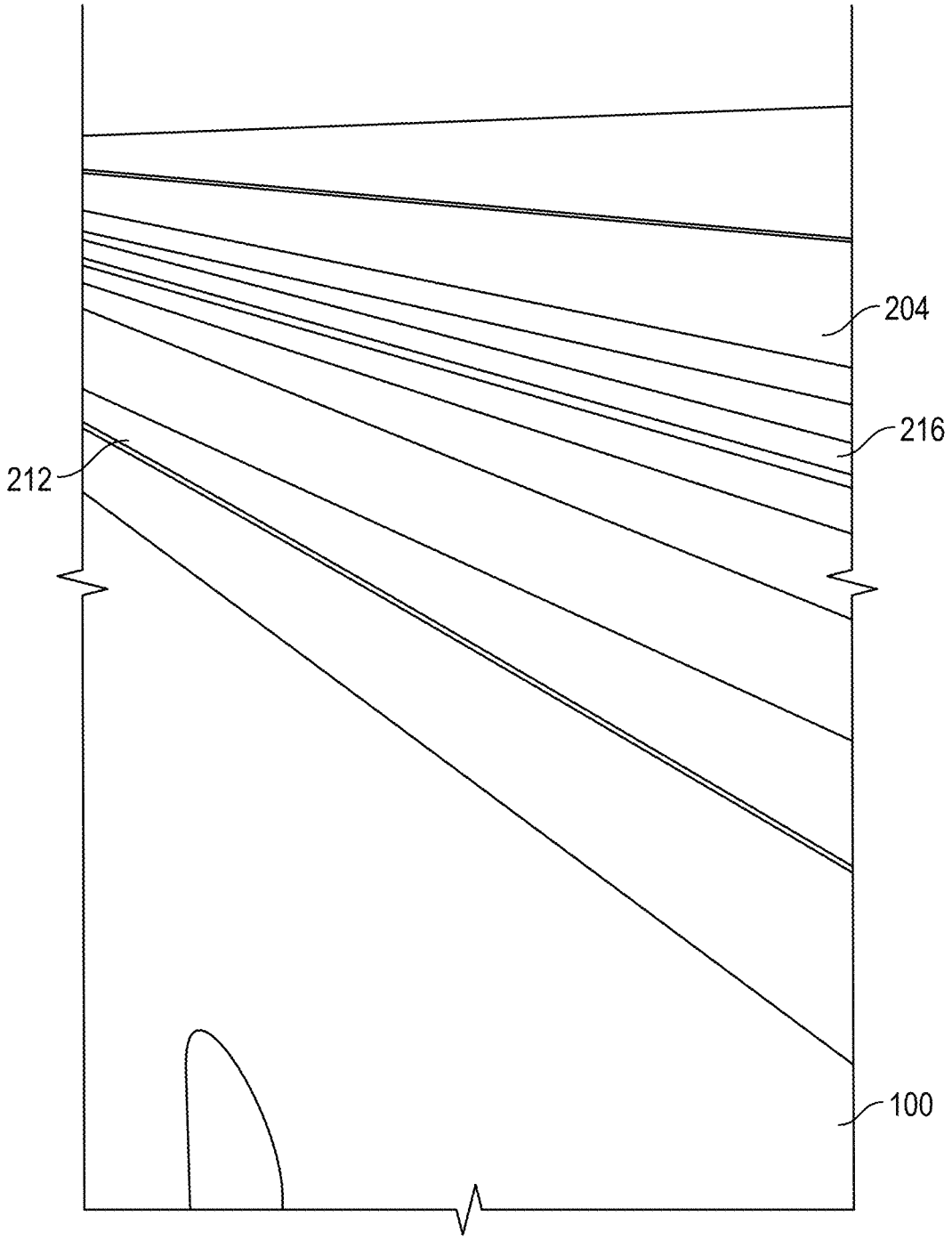
FIG. 2H illustrates a placement of the support bracket onto the tank, according to embodiments of the present invention disclosed herein.

FIG. 2H illustrates a placement of the support bracket 212 onto the back surface 102*f* of the tank 100, according to embodiments of the present invention. In an embodiment of the present invention, the protrusion 214 of the support bracket 212 may be inserted and/or plugged into the attachment indentation 110*b* of the tank 100 (as shown and explained in conjunction with FIG. 2E). As the protrusion 214 of the support bracket 212 may be plugged into the attachment indentation 110 of the tank 100, the support bracket 212 may start to overlap the top frame 204 and the tank 100. Further, upon fixation of the support bracket 212 using the protrusion 214, the support bracket 212 may provide a guarding boundary to the top frame 204, as the support bracket 212 may be overlapping the top frame 204 and the tank 100. The support bracket 212 may further be installed onto the tank 100 in such a manner that the slide track 216 may be easily and always accessible by the user.

Figure 2I:
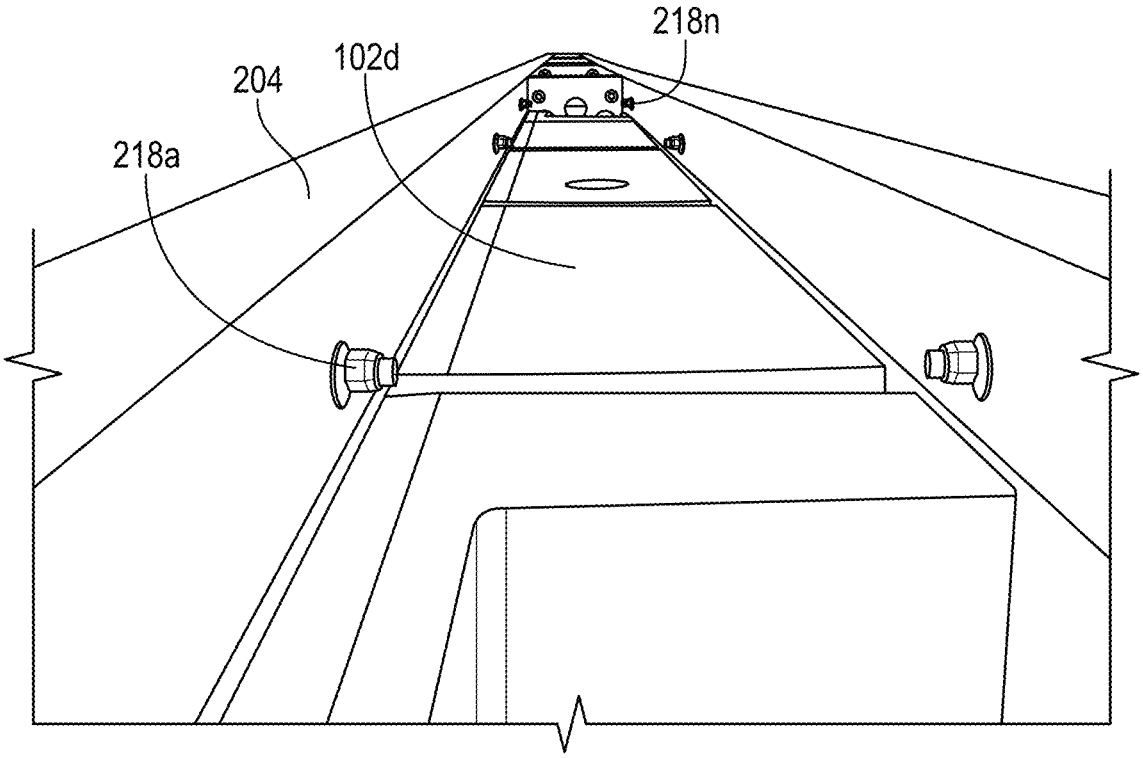
FIG. 2I illustrates a fixation of the top frame and the support bracket onto the tank, according to embodiments of the present invention disclosed herein.

FIG. 2I illustrates a fixation of the top frame 204 and the support bracket 212 onto the tank 100, according to embodiments of the present invention. In an embodiment of the present invention, after inserting and/or plugging the protrusion 214 into the attachment indentations 110 of the tank 100, and placing the support bracket 212 in an overlapping manner over the top frame 204 and the tank 100. Further, the top frame 204 and the support bracket 212 may be connected through the fasteners. The fasteners may be deployed to ensure an immovable nuptial of the top frame 204 and the support bracket 212 with respect to the top surface 102*d* of the tank 100. In a preferred embodiment of the present, the fasteners deployed with the top frame 204 and the support bracket 212 may be the studs and bolts 218*a*-218*n*. The studs and bolts 218*a*-218*n* may be adapted to pass through sockets (not shown). The sockets may be provisioned in the top frame 204 and the support bracket 212. The sockets in the top frame 204 and the support bracket 212 may be aligned in a straight line of sight. Upon alignment of the sockets, the studs and bolts 218*a*-218*n* may be inserted into the sockets. A complete through passage and insertion of the studs and bolts 218*a*-218*n* in the sockets may ensure the top frame 204 and the support bracket 212 are bonded together. Further, after insertion of the studs and bolts 218*a*-218*n* in the sockets, a rear end of the studs and bolts 218*a*-218*n* may be secured using means such as, but not limited to, bolts, washers, rivets, roll plugs, and so forth. Embodiments of the present invention are intended to include or otherwise cover any means that may secure the studs and bolts 218*a*-218*n* into the sockets of the top frame 204 and the support bracket 212, including known, related art, and/or later developed technologies.

Figure 2J:
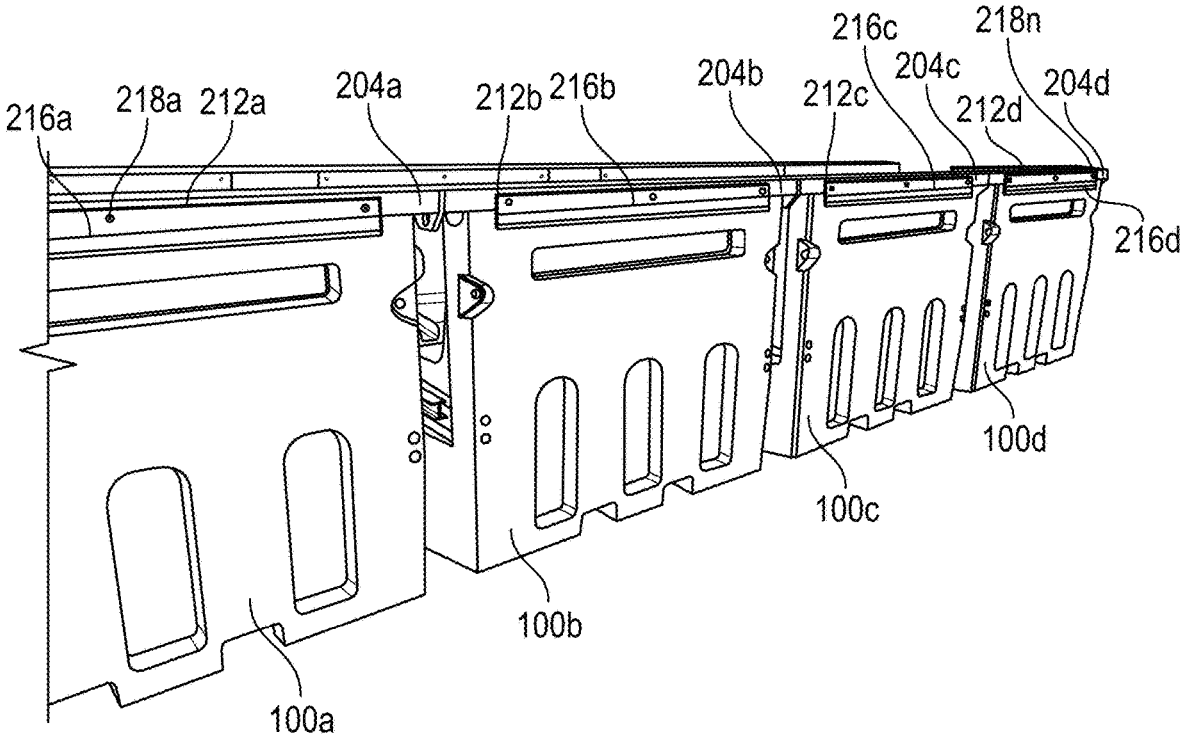
FIG. 2J illustrates a series combination of the tanks, according to embodiments of the present invention disclosed herein.

FIG. 2J illustrates the series combination of the tanks 100*a*-100*d*, according to embodiments of the present invention. In an embodiment of the present invention, the series combination of the tanks 100*a*-100*d* may be achieved using peripherals such as, the top frame 204, the attachment brackets 206*a*-206*b*, the recesses 208*a*-208*n*, the connecting bolts 210, the support bracket 212, the protrusion 214, and the studs and bolts 218*a*-218*n*.

In an embodiment of the present invention, the tank 100*a* may be prepared by mounting a top frame 204*a* on the top surface 102*d* of the tank 100*a*. Further, a support bracket 212*a* may be placed in the attachment indentation 110 of the tank 100*a* (as shown in the FIG. 2E). After mounting of the top frame 204*a* and placement of the support bracket 212*a* on the tank 100*a*, the studs and bolts 218*a*-218*n* may be completely passed through, inserted, and securely fastened in corresponding sockets of the top frame 204*a* and the support bracket 212*a* (as shown in FIG. 2I). After fastening the studs and bolts 218*a*-218*n*, the tank 100*a* may be ready for participation in the floating boat lift 200.

Similarly, the tanks 100*b*-100*d* may be prepared by mounting corresponding top frames 204*b*-204*d* on corresponding top surfaces 102*d*. Further, the support brackets 212*b*-212*d* may be placed in the corresponding attachment indentations 110 of the tanks 100*b*-100*d*. After mounting of the corresponding top frames 204*b*-204*d* and placement of the support brackets 212*b*-212*d* on the tanks 100*b*-100*d*, the studs and bolts 218*a*-218*n* may be completely passed through, inserted, and securely fastened in corresponding sockets of the corresponding top frames 204*b*-204*d* and the support brackets 212*b*-212*d*. After fastening of the studs and bolts 218*a*-218*n*, the tanks 100*b*-100*d* may be ready for participation in the floating boat lift 200.

Furthermore, the tanks 100*a*-100*d* may be aligned in a straight line. The alignment in the straight line may allow the recesses 208*a*-208*n* of the attachment brackets 206*a*-206*b* of the top frames 204*a*-204*d* to be axially aligned. Further, the connecting bolts 210 may be inserted into the recesses 208*a*-208*n* to join the top frame with the adjoining top frame. For example, the connecting bolts 210 inserted into the recesses 208*a*-208*n* of the attachment brackets 206*a*-206*b* of the top frame 204*a* may be extended to enable the passage of the corresponding connecting bolts 210 into the recesses 208*a*-208*n* of the attachment brackets 206*a*-206*b* of the top frame 204*b*. The passage of the corresponding connecting bolts 210 through the recesses 208*a*-208*n* of the attachment brackets 206*a*-206*b* of the top frame 204*a* and the top frame 204*b* may establish the series combination of the tank 100*a*-tank 100*b*. Similarly, the series combination of the tank 100*b*-tank 100*c* and the series combination of the tank 100*c*-tank 100*d* may be established. Moreover, upon establishment of the series combination the tanks 100*a*-100*d* using the peripherals as discussed above, the slide tracks 216*a*-216*d* may automatedly be aligned in the straight line. The alignment of the slide tracks 216*a*-216*d* in the straight line may enable accommodation of the accessories relating to the establishment of the floating boat lift 200.

Furthermore, n' number of tanks 100 may be cojoined in the series combination, utilizing the top frames 204 and the support brackets 212, to generate the first series combination of the tanks 100 and the second series combination of the tanks 100. Where 'n' may be any positive integer. Additionally, the series combination of the tanks 100 generated using the top frames 204 and the support bracket 212 may discourage puncturing of the tanks 100. More specifically, the top frames 204 and the support brackets 212 may be installed externally using ports, sockets, and indentations so as to not puncture the tanks 100. Hence, the clamping means of the top frame 204 and support brackets may allow for increased structural integrity of the floating boat lift 200 and may increase the total life expectancy of the floating boat lift 200.

Moreover, the first series combination of the tanks 100 and the second series combination of the tanks 100 may be parallelly intrinsically joined to construct the floating boat lift 200. The parallel combination of the prepared series combination of the tanks 100 may be explained sequentially in detail in conjunction with FIG. 3A.

Figure 3A:
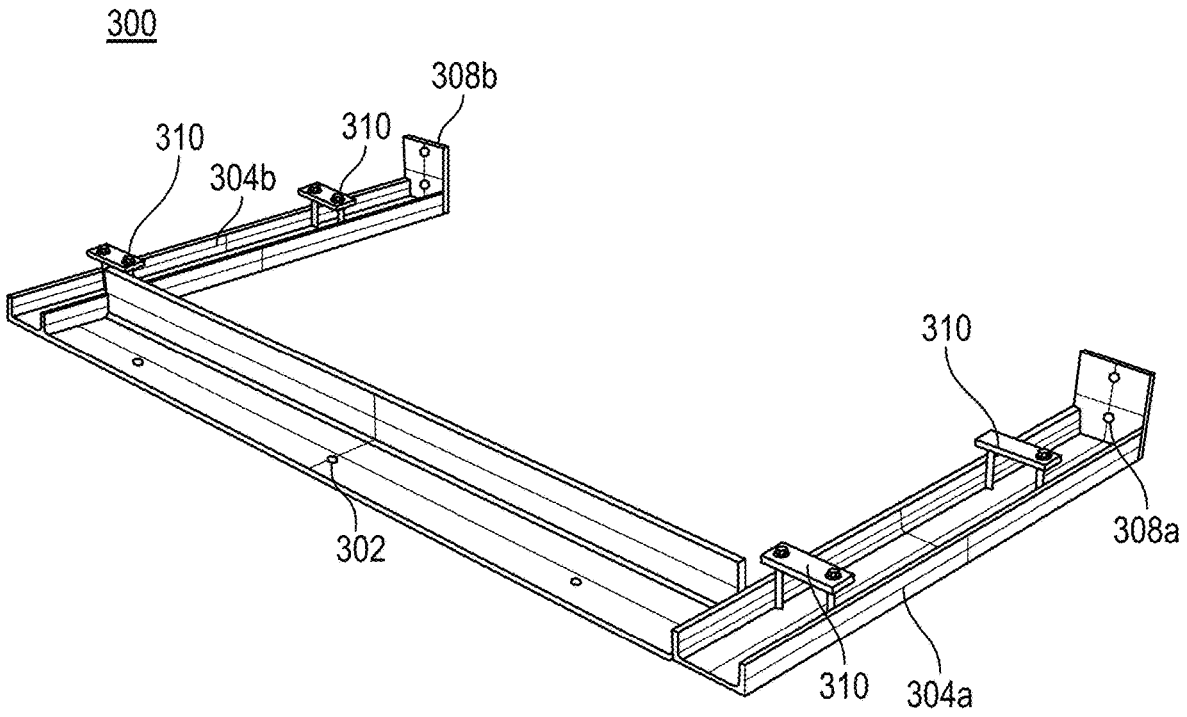
FIG. 3A illustrates a weldment, according to embodiments of the present invention disclosed herein.

FIG. 3A illustrates a weldment 300 (hereinafter referred individually to as the weldment 300, and plurally to as the weldments 300), according to embodiments of the present invention. The weldment 300 may comprise a structural channel 302, C-channels 304*a*-304*b*, end plates 308*a*-308*b*, and a plurality of mounting bolts 310. In a preferred embodiment of the present invention, the mounting bolts 310 may be stainless hex head bolts but may comprise any other similar fasteners. In an embodiment of the present invention, each of the C-channels 304*a*-304*b* may comprise a single piece fabrication for incorporation into the floating boat lift 200. In an embodiment of the present invention, the C-channels 304*a*-304*b* may be arranged and installed at a right side and a left side of the structural channel 302. Further, the end plates 308*a*-308*b* may be arranged and installed on the C-channels 304*a*-304*b* at a side distal from the structural channel 302. The end plates 308*a*-308*b* may comprise holes to accommodate the fastener. In an embodiment of the present invention, the end plates 308*a*-308*b* may be horizontally attached to the tank 100 by using the fasteners. Furthermore, the plurality of mounting bolts 310 may be arranged and installed on the C-channels 304*a*-304*b*. In a preferred embodiment of the present invention, the tank 100 further comprises a cavity to accommodate the C-channels 304*a*-304*b*.

The structural channel 302 may be constructed of any material such as, but not limited to, stainless steel, aluminum, carbon fiber, iron, and so forth. Embodiments of the present invention are intended to include or otherwise cover any material for construction of the structural channel 302, including known, related art and/or later developed technologies.

The C-channels 304*a*-304*b* may be constructed of any material such as, but not limited to, stainless steel, aluminum, carbon fiber, iron, and so forth. Embodiments of the present invention are intended to include or otherwise cover any material for construction of the C-channels 304*a*-304*b*, including known, related art, and/or later developed technologies.

The end plates 308*a*-308*b* may be constructed of any material such as, but not limited to, stainless steel, aluminum, carbon fiber, iron, and so forth. Embodiments of the present invention are intended to include or otherwise cover any material for construction of the end plates 308*a*-308*b*, including known, related art, and/or later developed technologies.

Each of the plurality of mounting bolts 310 may be constructed of any material such as, but not limited to, stainless steel, aluminum, carbon fiber, iron, and so forth. Embodiments of the present invention are intended to include or otherwise cover any material for construction of the plurality of mounting bolts 310, including known, related art and/or later developed technologies.

Figure 3B:
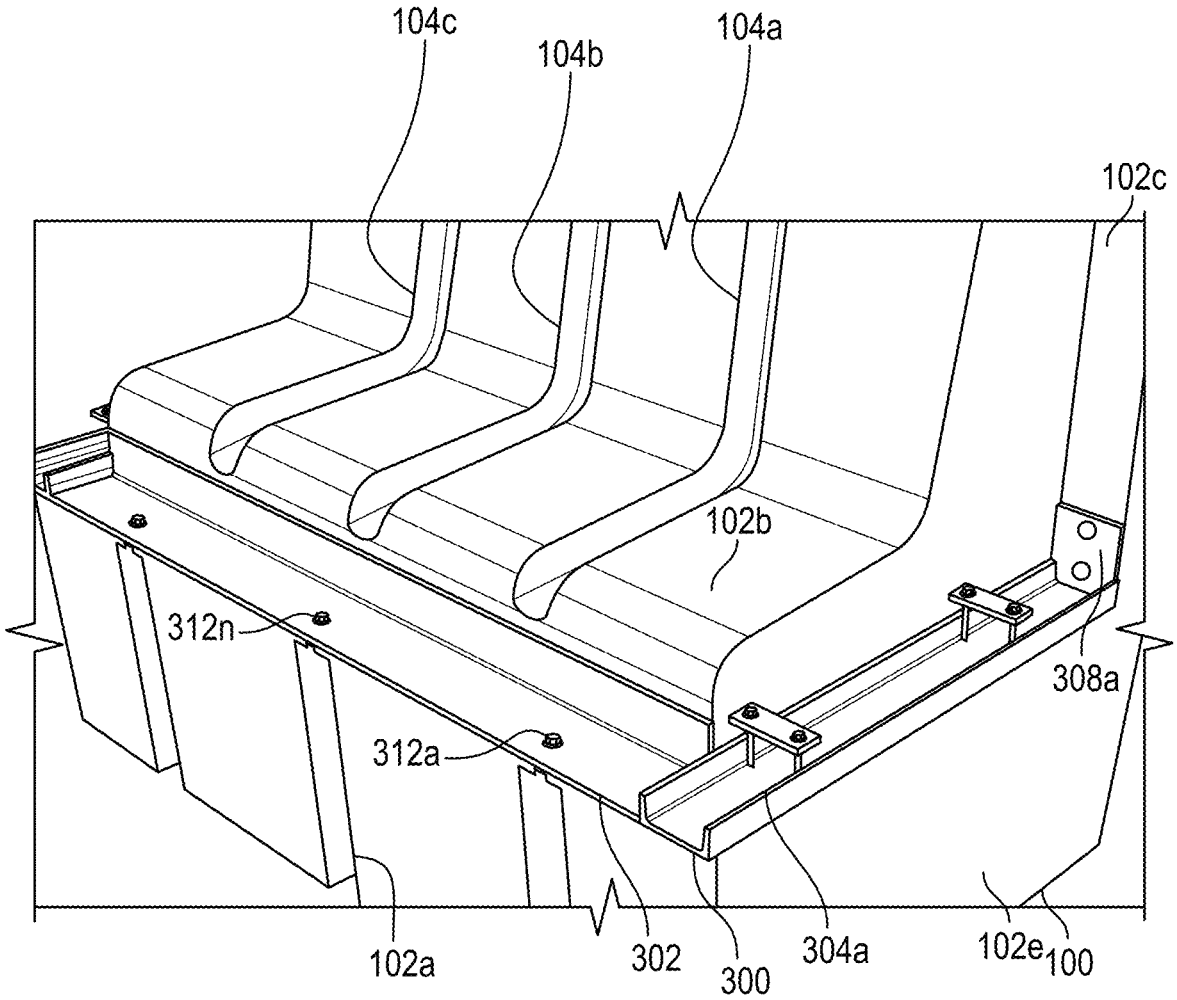
FIG. 3B illustrates an installation of the weldment on the tank, according to embodiments of the present invention disclosed herein.

FIG. 3B illustrates an installation of the weldment 300 on the tank 100, according to an embodiment of the present invention. In an embodiment of the present invention, the weldment 300 may be installed on the tank 100 in such a manner that the structural channel 302 of the weldment 300 may rest on the middle surface 102*b* of the tank 100 above the lower surface 102*a*. Further, a combination of the fasteners may secure the structural channel 302 on the middle surface 102*b* of the tank 100. In a preferred embodiment of the present invention, the fasteners used to secure the structural channel 302 on the middle surface 102*b* of the tank 100 may be, but not limited to, nut-bolts 312*a*-312*n*. In a preferred embodiment of the present invention, fastening of the weldment 300 on the tank 100 is achieved by inserting and securing fasteners through multiple recesses and/or openings (not shown) of the structural channel 302 and corresponding multiple external recesses and indentations in the in the tank 100 to secure the weldment 300 to the tank 100 without puncturing through the tank 100. In an embodiment of the present invention, the front lower surface 102(*a*) of the tank 100 may comprise external cavities to allow for the fastening of the structural channel 302 of the weldment 300 to the tank 100 without piercing the tank 100 to maintain the structural integrity of the tank 100.

In a similar embodiment of the present invention, the weldment 300 may be installed on the tank 100 in such a manner that the C-channels 304*a*-304*b* of the weldment 300 may rest on the middle surface 102*b*, above the side surface 102*e* of the tank 100. Further, the mounting bolts 310 may secure the C-channels 304*a*-304*b* on the side surface 102*e* to the tank 100. For securing the C-channels 304*a*-304*b* on the tank 100, the mounting bolts 310 may secure the end plates 308*a*-308*b* onto the upper middle surface 102*c* of the tank 100.

In a further embodiment of the present invention, the C-channels 304*a*-304*b* of the weldment 300 may be installed and secured on both of the side surface 102*e* (a right-side surface and a left-side surface) of the tank 100, as discussed above. In an embodiment of the present invention, only the single tank 100 may be depicted and explained for installation of the weldment 300. Moreover, a plurality of the tanks 100 are utilized for construction of the floating boat lift 200, which may be installed with the weldment 300 using a similar process, as explained above.

Figure 3E:
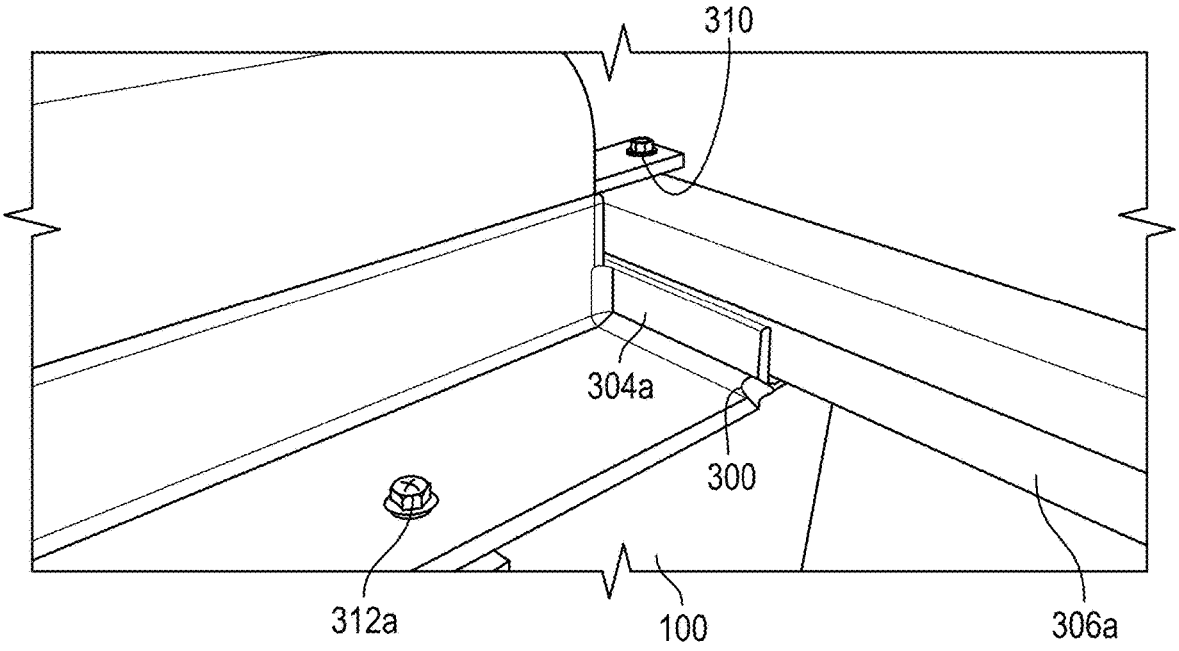

FIGS. 3C-3E illustrate an installation of tubings 306*a*-306*b* on the weldment 300 on the tank 100, according to an embodiment of the present invention. In an embodiment of the present invention, after installation of the weldment 300 on the tank 100, the tubings 306*a*-306*b* may be inserted into the cavity of the C-channels 304*a*-304*b* (a tubing 306*a* may be inserted in a C-channel 304*a* on a left side of the tank 100, and a tubing 306*b* may be inserted in a C-channel 304*b* on a right side of the tank 100).

In an embodiment of the present invention, the tubings 306*a*-306*b* inserted into the C-channels 304*a*-304*b* may be secured by using the plurality of mounting bolts 310. In a preferred embodiment of the present invention, the mounting bolts 310 may be used to secure the tubings 306*a*-306*b*. The plurality of mounting bolts 310 on the C-channels 304*a*-304*b* may be loosened up to make clearance for the tubings 306*a*-306*b*. After insertion of the tubings 306*a*-306*b* inside the cavity of the C-channels 304*a*-304*b*, the plurality of the mounting bolts 310 may be fastened. The plurality of the mounting bolts 310 may be fastened in such a rigid manner that there may be no movement of the tubings 306*a*-306*b* inside the cavity of the C-channels 304*a*-304*b*. In an embodiment of the present invention, the length of the tubings 306*a*-306*b* inserted into the C-channels 304*a*-304*b* may be greater than half of a width of the watercraft 202.

FIG. 4A illustrates a bunking structure 400, according to an embodiment of the present invention. In an embodiment of the present invention, the bunking structure 400 may be adapted to accommodate a hull of the watercraft 202. The bunking structure 400 may comprise railings 402*a*-402*b* and fish plates 404*a*-404*n*. In an embodiment of the present invention, the railings 402*a*-402*b* may be adapted to accommodate the hull of the watercraft 202. The fish plates 404*a*-404*n* may be adapted for an arrangement of the railings 402*a*-402*b* onto the tubings 306*a*-306*b* extruding from the cavity of the C-channels 304*a*-304*b* of the weldment 300. The railings 402*a*-402*b* may be constructed of any material such as, but not limited to, stainless steel, aluminum, carbon fiber, iron, and so forth. Embodiments of the present invention are intended to include or otherwise cover any material for construction of the railings 402*a*-402*b*, including known, related art, and/or later developed technologies. The fish plates 404*a*-404*n* may be constructed of any material such as, but not limited to, stainless steel, aluminum, carbon fiber, iron, and so forth. Embodiments of the present invention are intended to include or otherwise cover any material for construction of the fish plates 404*a*-404*n*, including known, related art and/or later developed technologies.

FIG. 4B illustrates an installation of the bunking structure 400 on the plurality of the tanks 100 to construct the floating boat lift 200, according to an embodiment of the present invention. In an embodiment of the present invention, the weldment 300 may be used to connect the plurality of the tanks 100 for the construction of the floating boat lift 200. The weldments 300 installed on the tanks 100 may be installed with the tubings 306*a*-306*b* inserted into the cavity of the C-channels 304*a*-304*b*. Further, after installation of the weldment 300 on the tanks 100 utilized for construction of the floating boat lift 200, the series combination of the tanks 100 (obtained after installation of the top frame 204 on the attachment brackets 208*a*-208*b* arranged onto the upper middle surface 102*c* and the back surface 102*f* of the tank 100) may be laid out in the parallel manner (as shown in the FIG. 1F). The parallel layout of the tanks 100 may be such that the tubings 306*a*-306*b* extending out from the cavity of the C-channels 304*a*-304*b* in the first series combination may tend to make an opposite (face-to-face) contact with the tubings 306*a*-306*b* extending out from the cavity of the C-channels 304*a*-304*b* from the second series combination of the tanks 100.

In an embodiment of the present invention, the tubings 306*a*-306*b* extending out from the first series combination and the second series combination may be adapted to be co-joined in the middle of the floating boat lift 200 using the bunking structure 400. In an embodiment of the present invention, the railings 402*a*-402*b* of the bunking structure 400 may be arranged onto the tubings 306*a*-306*b* extending out from the first series combination and the second series combination of each of the tanks 100. Further, the railings 402*a*-402*b* may be arranged onto the tubings 306*a*-306*b* by admission of the fish plates 404*a*-404*n*. A first end of the fish plates 404*a*-404*n* may be bolted onto the tubings 306*a*-306*b*, and further, another end of the fish plates 404*a*-404*n* may be bolted onto the railings 402*a*-402*b*.

In another embodiment of the present invention, the tubings 306*a*-306*b* may extend from the first series combination with the opposite end of said tubings 306*a* and 306*b* being inserted and secured with the respective cavities of the respective C-channels 304*a*-304*b* of the second series combination to create a parallel combination having a solid and continuous means of support across the floating boat lift 200. In an embodiment of the present invention, the tubings 304*a*-304*b* are greater than the width of the watercraft 202 and may provide support for the bunking structure 400 and watercraft 202.

In another embodiment of the present invention, the tubings 306*a* and 306*b* may be adjustable in length to accommodate watercraft of different widths. In one embodiment of the present invention, the respective tubings 306*a* and 306*b* may be adjusted telescopically or by any means to obtain a desired length.

After bolting of the fish plates 404*a*-404*n* on the tubings 306*a*-306*b* (extending out from the cavity of the C-channels 304*a*-304*b* from the first series combination and the second series combination) with the railings 402*a*-402*b*, the individual series combination of the tanks 100 may be co-joined against each other (in the face-to-face manner) in the parallel manner for a final construction of the floating boat lift 200.

Figure 5:
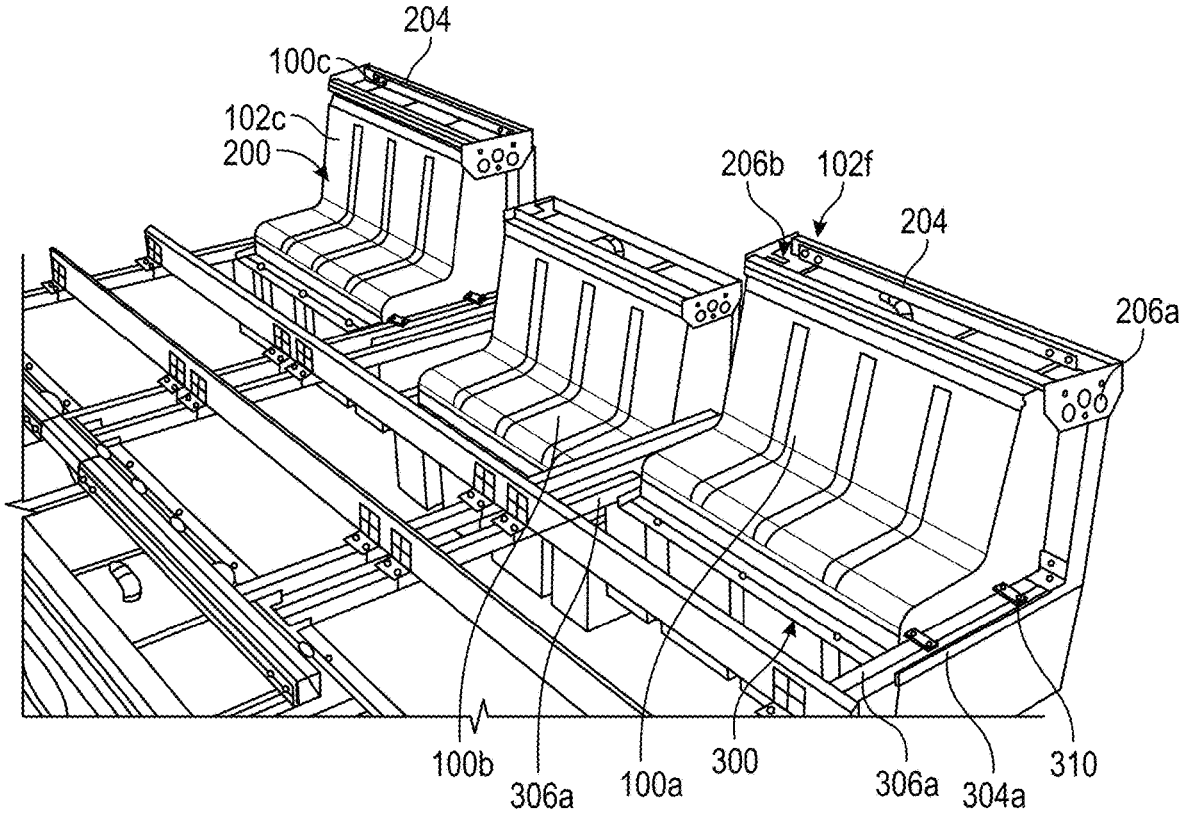
FIG. 5 illustrates a replacement of an individual tank from the floating boat lift, according to embodiments of the present invention disclosed herein.

FIG. 5 illustrates a replacement of the tank 100*b* from the floating boat lift 200, according to an embodiment of the present invention. In an exemplary scenario, the tank 100*b* may be replaced from the floating boat lift 200. For the replacement of the tank 100*b*, the top frame 204 of the corresponding tank 100*b* may be released from the top frames of the adjoining tanks 100*a* and 100*c* by the unfastening the connection bolts 210 of the attachment brackets 206*a*-206*b* installed on the tank 100*b*. The tank 100*b* may then be released from the floating boat lift 200 by unfastening of the mounting bolts 310 which secure the weldment 300 of the tank 100*b* to the respective tubings 306*a* and 306*b*. The mounting bolts 310 may be unfastened by fastening tools such as, but not limited to, a screwdriver, a wrench, an electric power drill, and so forth. Embodiments of the present invention are intended to include or otherwise cover any tool, including known, related art, and/or later developed technologies, for unfastening the mounting bolts 310 of the corresponding tank 100*b*.

Further, after removal of the top frame 204 by unfastening of the attachment brackets 206*a*-206*b*, the plurality of mounting bolts 310 of the weldment 300 may be unfastened using the fastening tools. After unfastening the plurality mounting bolts 310, the tubings 306*a*-306*b* secured in the C-channels 304*a*-304*b* of the weldment 300 may be released.

After releasing the tubings 306*a*-306*b* secured in the C-channels 304*a*-304*b*, and releasing the top frame 204 by unfastening the attachment brackets 208*a*-208*b* of the corresponding tank 100*b*, there may not be any resistance and connectivity of the corresponding tank 100*b* with the rest of the floating boat lift 200. The tank 100*b* may be pushed downwards for displacement and removal of the tank 100*b* from the floating boat lift 200. Once the tank 100*b* is removed from the floating boat lift 200, the top frame 204 may then be removed from the tank 100 by unfastening the respective support brackets 212.

Further, after removal of the tank 100*b*, a new replacement tank (not shown) may be placed at the corresponding position of the tank 100*b*. The new replacement tank may be preinstalled with the top frame 204. Additionally, the new replacement tank may further be installed with the weldment 300, using the above described process.

The new replacement tank may be aligned at a vacancy created by the removal of the tank 100*b* in the floating boat lift 200. The new replacement tank may be preinstalled with the weldment 300. Further, after alignment of the new replacement tank in the created vacancy, the tubings 306*a*-306*b* extending out from the floating boat lift 200 may be slotted in the C-channels 304*a*-304*b* in the weldment 300 of the new replacement tank. After slotting, the tubings 306*a*-306*b* may be secured in the C-channels 304*a*-304*b* by fastening the plurality of mounting bolts 310. The plurality of mounting bolts 310 may be fastened using the fastening tools.

After securing and fastening the tubings 306*a*-306*b* in the C-channels 304*a*-304*b* of the weldment 300 of the new replacement tank, the top frame 204 of the floating boat lift 200 may be arranged with support brackets 212 installed at the back surface 102*f* and upper middle surface 102*c* of the new replacement tank. The top frame 204 may be secured to with the support bracket 212 onto the tank 100 by fastening the studs and bolts 218*a*-218*n*. The studs and bolts 218*a*-218*n* may be fastened using the fastening tools. After a rigid and secure fastening of the studs and bolts 218*a*-218*n* and the top frame 204 with the support bracket 212, the new replacement tank may replace the tank 100*b*.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

The exemplary embodiments of this present invention have been described in relation to the floating boat lift. However, to avoid unnecessarily obscuring the present invention, the preceding description omits a number of known structures and devices. This omission is not to be construed as a limitation of the scope of the present invention. Specific details are set forth by use of the embodiments to provide an understanding of the present invention. It should however be appreciated that the present invention may be practiced in a variety of ways beyond the specific embodiments set forth herein.

A number of variations and modifications of the present invention can be used. It would be possible to provide for some features of the present invention without providing others.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present invention has been presented for purposes of illustration and description. It is not intended to limit the present invention to the form or forms disclosed herein. In the foregoing Detailed Description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The invention claimed is:

1. A floating boat lift, comprising:

a plurality of tanks, wherein each of the plurality of tanks comprises at least one attachment indentation;

a top frame positioned on a top surface of each of the plurality of tanks; and one or more support brackets comprising at least one protrusion to be inserted into the at least one attachment indentation of each of the plurality of tanks, wherein the one or more support brackets are further adapted to establish a connection with the top frame to secure the top frame over the top surface of each of the plurality of tanks.

2. The floating boat lift of claim 1, wherein the top frame comprises a plurality of attachment brackets.

3. The floating boat lift of claim 1, wherein the top frame comprises a walking surface.

4. The floating boat lift of claim 1, wherein the one or more support brackets and the top frame are connected through a plurality of fasteners thereby securing the top frame to the top surface of each of the plurality of tanks by a clamping means so as to not puncture the outer surface of each of the plurality of tanks.

5. The floating boat lift of claim 1, wherein the one or more support brackets comprise one or more slide tracks.

6. The floating boat lift of claim 1, wherein the top frame, the one or more support brackets, and the at least one protrusion are constructed of a marine-grade aluminum material.

7. The floating boat lift of claim 1, wherein the plurality of tanks are constructed of a hollow structure to enable buoyancy of the floating boat lift.

8. The floating boat lift of claim 1, wherein the plurality of tanks comprise one or more valves adapted for inclusion and/or exclusion of air from of the plurality of tanks.

9. The floating boat lift of claim 1, wherein the plurality of tanks comprise one or more structural indentations to provide structural stability to the floating boat lift.

10. The floating boat lift of claim 1, wherein the plurality of tanks comprise a lower surface, a middle surface, an upper middle surface, the top surface, a side surface, a bottom surface and a back surface.

11. The floating boat lift of claim 2, wherein the plurality of tanks are serially connected through the plurality of attachment brackets.

12. The floating boat lift of claim 5, wherein the one or more slide tracks are adapted to accommodate accessories relating to the floating boat lift.

13. A floating boat lift, comprising:

a top frame positioned longitudinally on a top surface of each of a plurality of tanks; and a plurality of attachment brackets attached to the top frame, wherein each of the plurality of attachment brackets comprises:

one or more recesses; and a plurality of fasteners, passing through the one or more recesses of the top frame to enable a series combination of the plurality of tanks.

14. The floating boat lift of claim 13, wherein one or more of the plurality of tanks are individually removable and replaceable from the series combination of the plurality of tanks.

15. The floating boat lift of claim 13, wherein the top frame is secured to the top surface of each of a plurality of tanks by a plurality of support brackets and plurality of fasteners to secure the top frame to the top surface of each of the plurality of tanks by a clamping means so as to not puncture the outer surface of each of the plurality of tanks.

16. The floating boat lift of claim 13, wherein the plurality of tanks comprise one or more valves adapted for inclusion and/or exclusion of air from of the plurality of tanks.

17. A floating boat lift, comprising:

a plurality of tanks, wherein each of the plurality of tanks is attached in a first series combination, comprising:

one or more weldments attached on each of the plurality of tanks, wherein each of the one or more weldments comprises:

one or more structural channels attached on a front side of each of the plurality of tanks using a plurality of fasteners;

a plurality of C-channels, wherein each of the plurality of C-channels is arranged on a right side and a left side of each of the plurality of tanks, wherein each of the plurality of C-channels is adapted to accommodate at least one tubing;

a plurality of mounting bolts installed on each of the plurality of C-channels, wherein the plurality of mounting bolts, are adapted to secure the at least one tubing accommodated in each of the plurality of C-channels; and a plurality of end plates extending from the plurality of C-channels, wherein each of the plurality of end plates is adapted to bind the one or more weldments with each of the plurality of tanks arranged in the first series combination.

18. The floating boat lift of claim 17, wherein a plurality of railings are installed on the at least one tubing extending from the plurality of C-channels of the one or more weldments.

19. The floating boat lift of claim 18, wherein the plurality of railings are secured to each of the at least one tubing using a plurality of fish plates.

20. The floating boat lift of claim 18, wherein each of the at least one tubing is adapted to be inserted in the plurality of C-channels installed on a second series combination of a plurality of tanks, enabling a parallel arrangement of the first series combination of the plurality of tanks with the second series combination of the plurality of tanks.

* * * * *